US007597598B2

(12) United States Patent
Rosenkranz et al.

(10) Patent No.: US 7,597,598 B2
(45) **Date of Patent: *Oct. 6, 2009**

(54) PROPELLER FOR A MARINE PROPULSION SYSTEM

(75) Inventors: Hans-Gunther Rosenkranz, Wantirna South (AU); Dmitri Shmatkov, Dandenong (AU); Mark Frederick Armstrong, Sunbury (AU)

(73) Assignee: Aimbridge Pty, Ltd., Melbourne (AU)

( * ) Notice: Subject to any disclaimer, the term of this patent is extended or adjusted under 35 U.S.C. 154(b) by 107 days.

This patent is subject to a terminal disclaimer.

(21) Appl. No.: 11/630,541

(22) PCT Filed: Dec. 6, 2004

(86) PCT No.: PCT/AU2004/001721

§ 371 (c)(1),
(2), (4) Date: Dec. 22, 2006

(87) PCT Pub. No.: WO2006/007625

PCT Pub. Date: Jan. 26, 2006

(65) Prior Publication Data

US 2008/0064275 A1 Mar. 13, 2008

(30) Foreign Application Priority Data

Jul. 20, 2004 (AU) ..... PCT/AU2004/000970

(51) Int. Cl.
*B63H 3/00* (2006.01)

(52) U.S. Cl. ..... 440/50; 416/133

(58) Field of Classification Search ..... 440/50; 416/133

See application file for complete search history.

(56) References Cited

U.S. PATENT DOCUMENTS

| | | | | |
|---|---|---|---|---|
| 1,864,045 | A * | 6/1932 | Kellogg et al. | 416/133 |
| 2,981,338 | A | 4/1961 | Hindmarch | |
| 4,643,643 | A | 2/1987 | Otto | |
| 4,753,572 | A | 6/1988 | Kusiak | |
| 4,897,056 | A * | 1/1990 | Muller | 440/50 |
| 6,688,926 | B1 * | 2/2004 | Willmot | 440/50 |

OTHER PUBLICATIONS

International Search Report dated Jan. 12, 2005.
International Preliminary Report on Patentability dated Jun. 14, 2006.

* cited by examiner

*Primary Examiner*—Stephen Avila
(74) *Attorney, Agent, or Firm*—Bromberg & Sunstein LLP

(57) ABSTRACT

A marine propulsion system comprising a push rod activated pins (170) which engage eccentric shaft (174) for unlocking a propeller base (190) so the base (190) can rotate around a transverse axis. The base (190) has an inclined surface (192) which engages with an inclined surface (159) defining an opening in the propeller's hub therefore locking the propeller blade (34) in position. The inclined surfaces (159, 192) are disengaged by rotation of the eccentric shaft (174) thus the propeller blades (34) can be rotated to adjust the pitch and then the inclined surfaces (159, 192) re-engage to locking the propeller blade (34) in the pitch adjusted position.

30 Claims, 17 Drawing Sheets

PROPELLER FOR A MARINE PROPULSION SYSTEM

FIELD OF THE INVENTION

This invention relates to a propeller for a marine propulsion system and, in particular, to a propulsion system suitable for an outboard motor or stern drive. However, the propeller has application to other drive systems, such as V-drives and direct drives.

BACKGROUND ART

Marine propulsion systems generally comprise outboard motors or stern drive systems which transmit rotary power to a propeller to drive a boat through water. The propeller includes propeller blades which are angled to provide propulsion through the water. The angle or pitch of the blades relative to a radial axis transverse to the drive axis of the propeller is generally fixed and selected to provide maximum efficiency at maximum speed or cruise speed of the boat to which the system is used. The pitch is generally less efficient at take-off when the boat is driven from stationary up to the cruise speed, which inefficiency results in increased fuel consumption and a longer time for the boat to move from the stationary to cruise speed. If the propeller has too large pitch, the power of the engine may not be sufficient to accelerate the boat to planing speed.

In order to overcome this problem, variable pitch propeller systems have been proposed in which the pitch of the propeller blades can be altered to suit the changing operating conditions of the propulsion system. Our International Application No. PCT/AU99/00276 discloses such a system which is particularly suitable for outboard motor applications.

Pitch control systems which are used in stern drives generally comprise hydraulic systems for adjusting the propeller pitch and are therefore relatively expensive and complicated. The size of such systems can also be of issue because it is generally desired that the drive system be as small as possible to minimise drag through the water and weight of the system.

SUMMARY OF THE INVENTION

The invention provides a propeller for a marine propulsion system, comprising:

- a propeller hub having a plurality of openings, and a hub surface surrounding each opening;
- a propeller blade having a propeller base mounted in each of the openings, each base having a base surface for engaging the hub surface of the respective opening;
- a mechanical and non-hydraulic unlocking mechanism for disengaging the respective base surface of the base from the respective hub surface of the hub for enabling rotation of the base, and therefore the propeller blade relative to the hub about an axis transverse to a rotation axis of the hub, by a sliding movement of the hub surface with respect to the base surface; and
- a pitch adjusting mechanism for rotating each base to thereby adjust the pitch of the propeller blade.

Preferably the propeller further comprises a mechanical and non-hydraulic re-locking mechanism for allowing re-engagement of the respective base surface of the base with the respective hub surface of the hub to lock the base in the pitch adjusted position.

Preferably the unlocking mechanism and the re-locking mechanism comprise a common locking and unlocking mechanism.

Preferably the re-locking mechanism allows re-engagement of the base surface with the hub surface by virtue of centrifugal force during operation of the propeller after the pitch adjusting mechanism has adjusted the pitch of the propeller blades.

Preferably the common locking and unlocking mechanism comprise a stem on each base, a respective eccentric coupled to each stem, a respective pin mounted to each eccentric, a push rod for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to re-engage the respective base surface of the bases with the respective hub surfaces of the openings to re-lock the bases and therefore the propeller blades in the pitch adjusted position.

Preferably the mechanical unlocking mechanism disengages the respective base surface from the respective hub surface by transferring load from the base surface and hub surface to thereby allow the hub surface and base surface to move relative to one another.

Preferably the unlocking mechanism comprises an eccentric, at least one engaging element on the eccentric, a slide surface arranged radially inwardly of the respective hub surface and base surface so that when the eccentric is rotated, load is transferred from the respective hub surface and base surface to the at least one element and slide surface so the respective propeller blades can be adjusted after the transfer of load with the at least one element sliding on the slide surface.

Preferably the slide surface is arranged on a fixed bridge.

Preferably the element comprises two elements, each element having a slide member and the slide surface being a ceramic slide surface for engaging with the slide members of the elements.

Preferably the eccentric is coupled to a pin for firstly rotating the eccentric about a first axis to transfer the load and then rotating the eccentric about a second axis transverse to the first axis to rotate the respective propeller blade to adjust the pitch of the propeller blade.

Preferably wherein the hub surface and the base surface are inclined cone-shaped surfaces.

Preferably the hub surface and base surface are substantially horizontal surfaces perpendicular to an axis about which the pitch of the propeller blades is adjusted.

Preferably the push rod is coupled to a claw which has a respective finger for each of the propeller blades, each finger being mounted to a respective pin by a socket and eye joint.

Preferably an adjusting mechanism is provided for enabling adjustment of the claw with respect to the push rod.

Preferably the adjusting mechanism comprises a bush screw threaded on the push rod by co-operating screw threads on the bush and push rod, the bush carrying the claw, and a locking nut for locking the bush and therefore the claw in a desired position relative to the push rod.

Preferably the pin locates in a recess in the base so that after the pin rotates the shaft, the pin engages the base to thereby rotate the base about the transverse axis to adjust the pitch of the propeller blade.

Preferably a fixed bridge is located between each base and each eccentric, the bridge having an arcuate slot through which the respective pin passes to accommodate movement of the pin relative to the bridge.

The invention also provides a marine propulsion system to be driven by a motor, the system comprising:

a propeller having a propeller hub and a plurality of propeller blades;

a drive for rotating the propeller about a first axis;

a pitch adjusting mechanism for adjusting the pitch of the propeller blades about respective axes transverse to the first axis;

a blade supporting mechanism for supporting the blades in the hub to allow adjustment of the pitch of the blades about the transverse axes, the supporting mechanism comprising:

an engaging element for movement by the adjusting mechanism to adjust the pitch of the blades;

the engaging element having an arm for each of the blades;

a joint carried by the arm;

a pin mounted in the joint;

an eccentric in engagement with the pin;

a propeller base connected to the eccentric, the propeller base having a base surface;

a base surface on the hub for engagement with the base surface on the base so the base surface of the base engages the base surface of the hub to lock the propeller in a pitch adjusted position; and wherein when the adjusting mechanism moves the adjusting element, the engagement between the flexible joint and the pin causes the joint and pin to first rotate the eccentric about an eccentric axis to disengage the base surface of the base and the hub surface of the hub, and whereupon further movement of the adjusting mechanism, and therefore the element, rotates the eccentric and the base relative to the hub about the transverse axis to adjust the pitch of the propeller blades.

Preferably the hub surface and base surface are tapered surfaces.

Preferably a biasing means is provided for biasing the base surface towards the hub wherein the biasing means also assists in biasing the eccentric and pin back towards an equilibrium position.

Preferably the joint comprises an outer socket and an inner moveable eye in the socket which carries the pin.

Preferably the eccentric is an eccentric shaft.

Preferably the base includes a stem which engages the eccentric shaft so that rotation of the eccentric shaft about the eccentric axis moves the base relative to the hub in a radial direction so the tapered surface of the base can disengage from the tapered surface of the hub, and continued movement of the arm rotates the eccentric shaft about the respective transverse axis to thereby adjust the pitch of the blade relative to the hub about the respective transverse axis.

Preferably the drive comprises:

a first drive shaft for receiving rotary power from the motor;

a second drive shaft arranged transverse to the first drive shaft;

a first gear on the first drive shaft;

a second gear on the second drive shaft meshing with the first gear so that drive is transmitted from the first drive shaft via the gears to the second drive shaft; and the propeller hub being connected to the second drive shaft for rotation with the second drive shaft.

Preferably the pitch adjusting mechanism comprises a push member for moving the engaging element to thereby move the propeller blades and adjust the pitch of the propeller blades, the push member having a screw thread, a nut member having a screw thread and engaging the screw thread of the push member, and a control mechanism for rotating the nut to move the push member because of the engagement of the screw thread of the push member, and the screw thread on the nut, so the push member is moved in a linear manner to move the element to thereby increase the pitch of the propeller blades.

Preferably the push member comprises a push rod and a bolt provided about the push rod so the push rod can rotate relative to the bolt, the screw thread of the push member being provided on the bolt, the bolt having a chamber for receiving a thrust portion of the push rod so that upon rotation of the nut in one direction, the bolt is moved in a first direction parallel to the first axis and the push rod is moved with the bolt whilst being able to rotate within the bolt because of the engagement of the thrust portion in the chamber, and upon rotation of the nut member in the opposite direction, the bolt and the push rod are moved in a second direction opposite the first direction parallel to the first axis because of the engagement of the thrust portion of the push rod in the chamber.

Preferably the second drive shaft is hollow and the push rod is arranged in the second drive shaft so that the push rod can rotate with the second drive shaft whilst being moveable in the first and second directions along the first axis.

Preferably the push rod has a retaining member for retaining the bolt for movement in the direction of the first axis, but preventing rotation of the bolt about the first axis.

Preferably the chamber is formed by a flange on the bolt and a cover connected to the flange, the thrust portion of the push rod having a pair of thrust surfaces, and thrust bearing disposed between one of the thrust surfaces and the flange, and the other of the thrust surfaces and the cover.

Preferably the disengagement of the base surface and the hub surface comprises a transfer of load from the base surface and hub surfaces so the base surface and hub surfaces can rotate relative to one another by a sliding action.

BRIEF DESCRIPTION OF THE DRAWINGS

A preferred embodiment of the invention will be described, by way of example, with reference to the accompanying drawings, in which.

DETAILED DESCRIPTION OF THE PREFERRED EMBODIMENT

Figure 1:
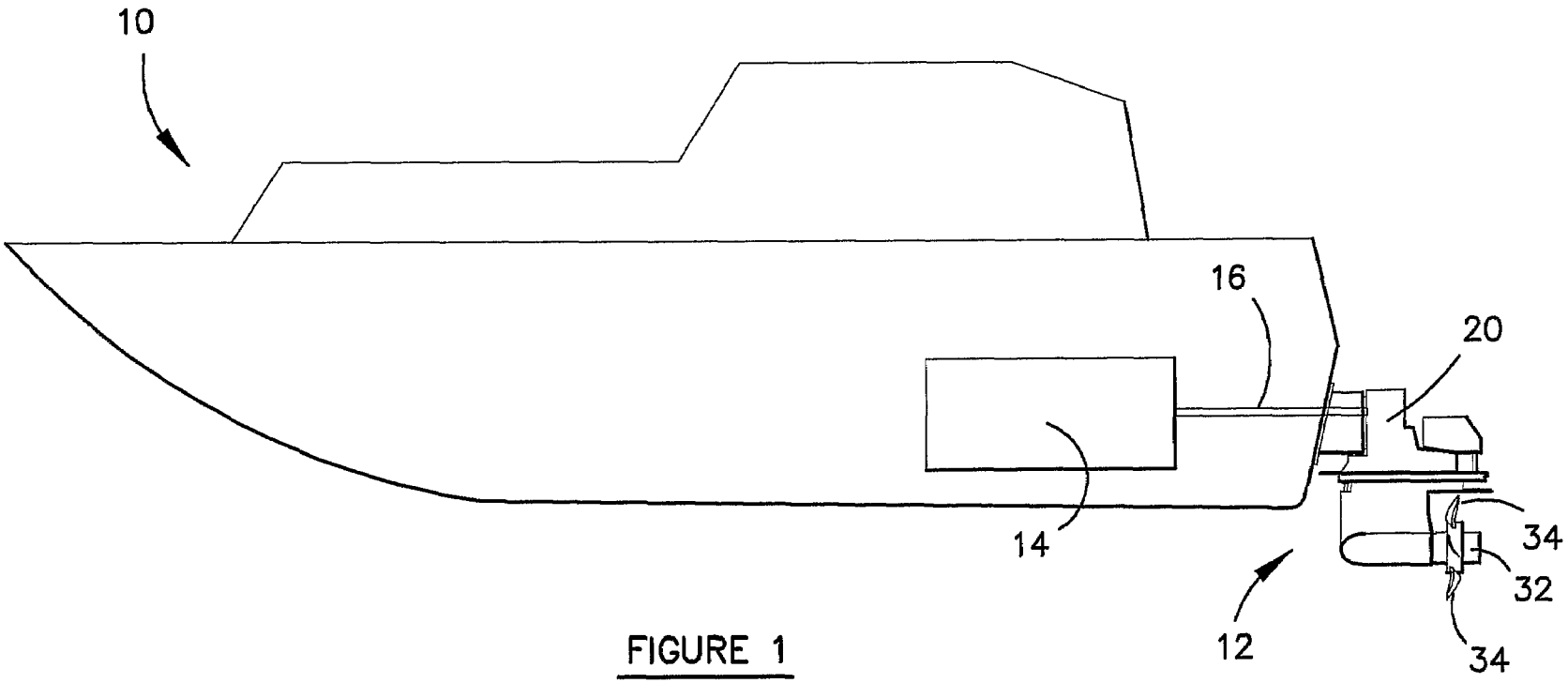
FIG. 1 is a schematic view of a boat having a stern drive according to the preferred embodiment of the invention.

With reference to FIG. 1, a boat 10 is shown having a stern drive 12. The stern drive 12 is powered from a motor 14 within the boat via a main drive shaft 16.

Figure 2:
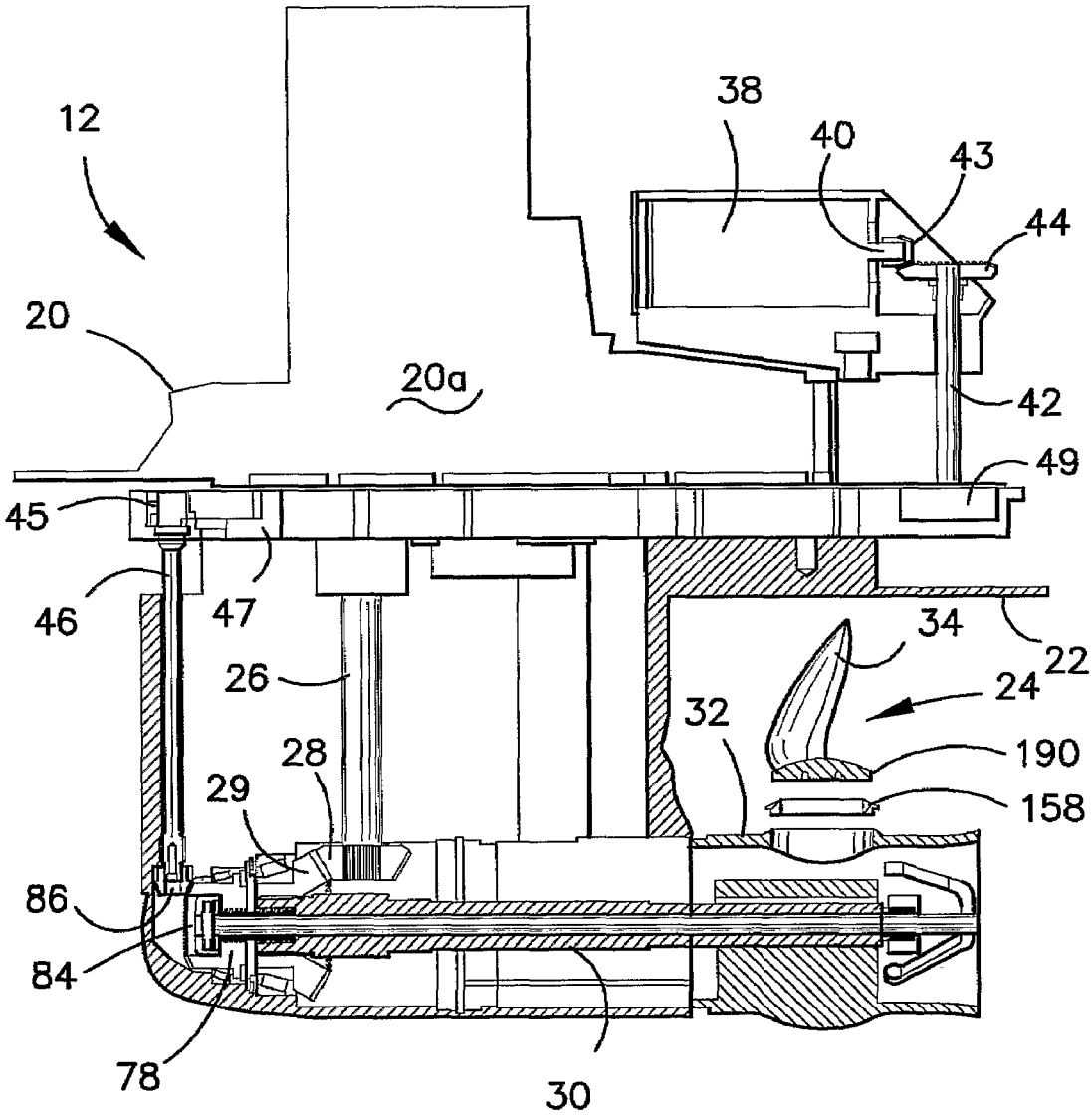
FIG. 2 is a partially cross-sectional view through the propulsion system of the stern drive of FIG. 1.

As is shown in FIG. 2, the stern drive 12 has a casing generally shown at 20 which includes a cavitation plate 22. The cavitation plate 22 is at about water level when the boat is planing and prevents air from being sucked into propeller 24. A drive shaft 26 receives rotary power from the main drive 16 shown in FIG. 1 by way of a gear arrangement (not shown) which is conventional and therefore need not be described. The drive shaft 26 carries a bevel gear 28 which in turn meshes with a bevel gear 29 connected to a second drive shaft 30 which is arranged generally perpendicular to the drive shaft 26. The drive shaft 30 connects to hub 32 of the propeller 24 for rotating the hub 32 and the propeller blades 34 which are coupled to the hub 32. It should be understood that in FIG. 2 only one propeller blade 34 is shown in an exploded position. In the embodiment shown, three propeller blades 34 are provided. However, the propeller may have more or less than three blades.

A control motor 38 is mounted rearwardly of the stern drive 12 and has a drive shaft 40 which drives an output shaft 42 via bevel gear arrangement 43 and 44. The output shaft 42 carries a gear sprocket 49. A gear sprocket 45 is arranged at the front of the stern drive 12 having regard to the position the stern drive takes up when powering a boat, and the sprocket gear 45 is connected to a control shaft 46. A flexible chain drive 47 engages the sprockets 45 and 49 so that drive can be transmitted from the motor 38 to the output shaft 42, and then to the chain 47 so the chain rotates the sprocket 45 and therefore the control shaft 46.

Figure 3:
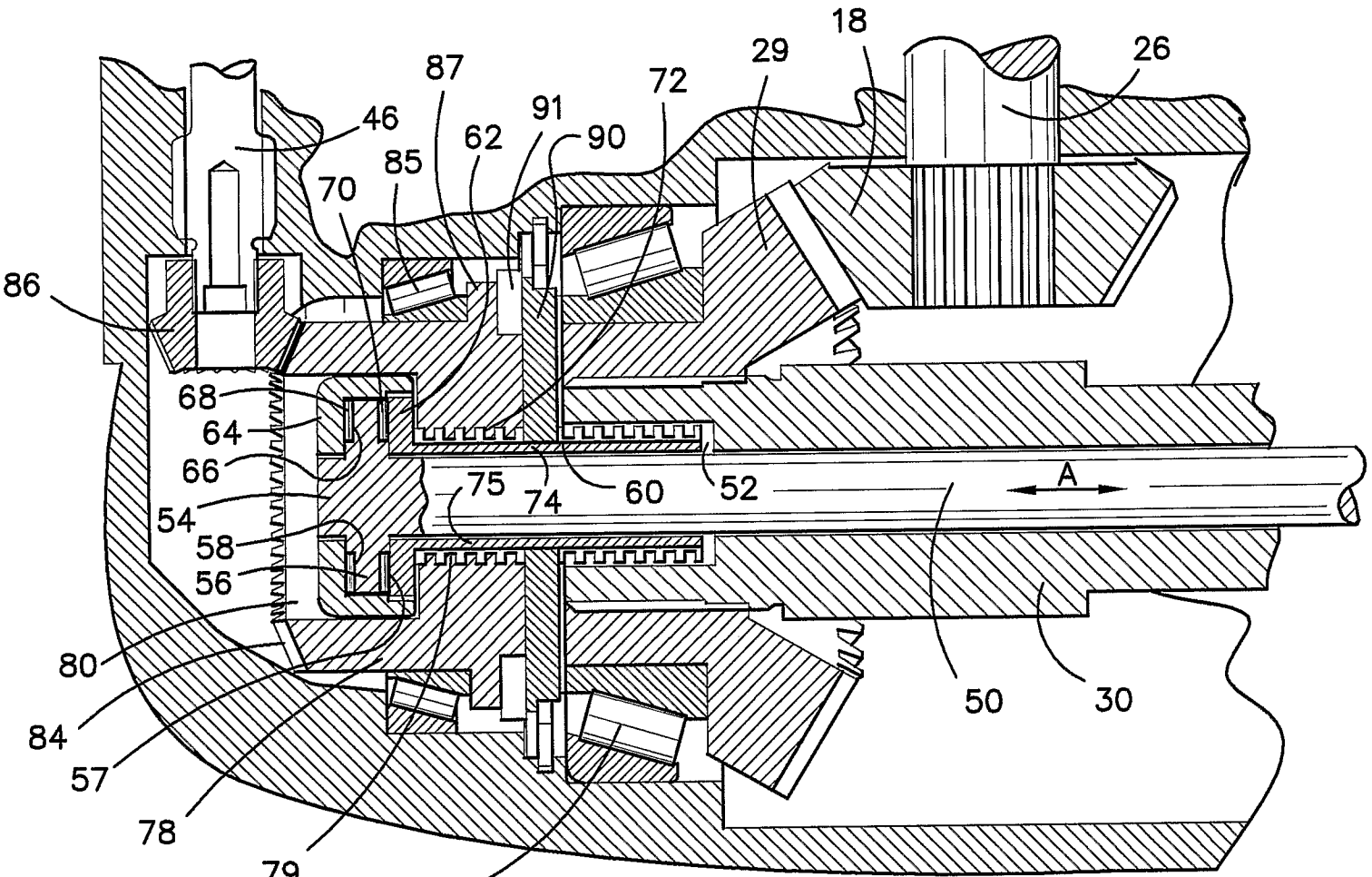
FIG. 3 is a more detailed view of part of the system shown in FIG. 2.

As is best shown in FIG. 3, the bevel gear 29 is mounted in bearing 47 and the bevel gear 29 is splined to the second drive shaft 30 so the second drive shaft 30 rotates when the bevel gear 29 is driven by the first drive shaft 26 and the bevel gear 18.

The drive shaft 30 is hollow and a push rod 50 is arranged in the drive shaft 30. As will be described in more detail hereinafter, the push rod 50 is connected to a coupling mechanism in the hub 32 and the push rod 50 rotates with the drive shaft 30 when the drive shaft is driven to propel the boat 10. The drive shaft 30 has a recess 52 at its end remote from the propeller hub 32.

The push rod 50 has an enlarged diameter thrust portion 54 which carries an annular abutment 56 which has a first abutment surface 57 and a second abutment surface 58.

A bolt 60 is mounted about the push rod 50 and is accommodated in the recess 52, as is shown in FIG. 3. The bolt 60 carries a flange 62 at its end opposite the recess 52, and the flange 62 is connected to a generally cup-shaped cover 64. The cover 64 and flange 62 define an internal chamber 66 in which the enlarged diameter portion 54 and the thrust portion 56 are accommodated so the rod 50 and the portions 54 and 56 can rotate in the chamber 66. A first thrust bearing 68 is arranged between the surface 58 and the cover 64 and a second thrust bearing 70 is arranged between the surface 57 and the flange 62. The cover 64 can be fixed to the flange 62 by a circlip or otherwise connected to the flange 62.

Figure 4:
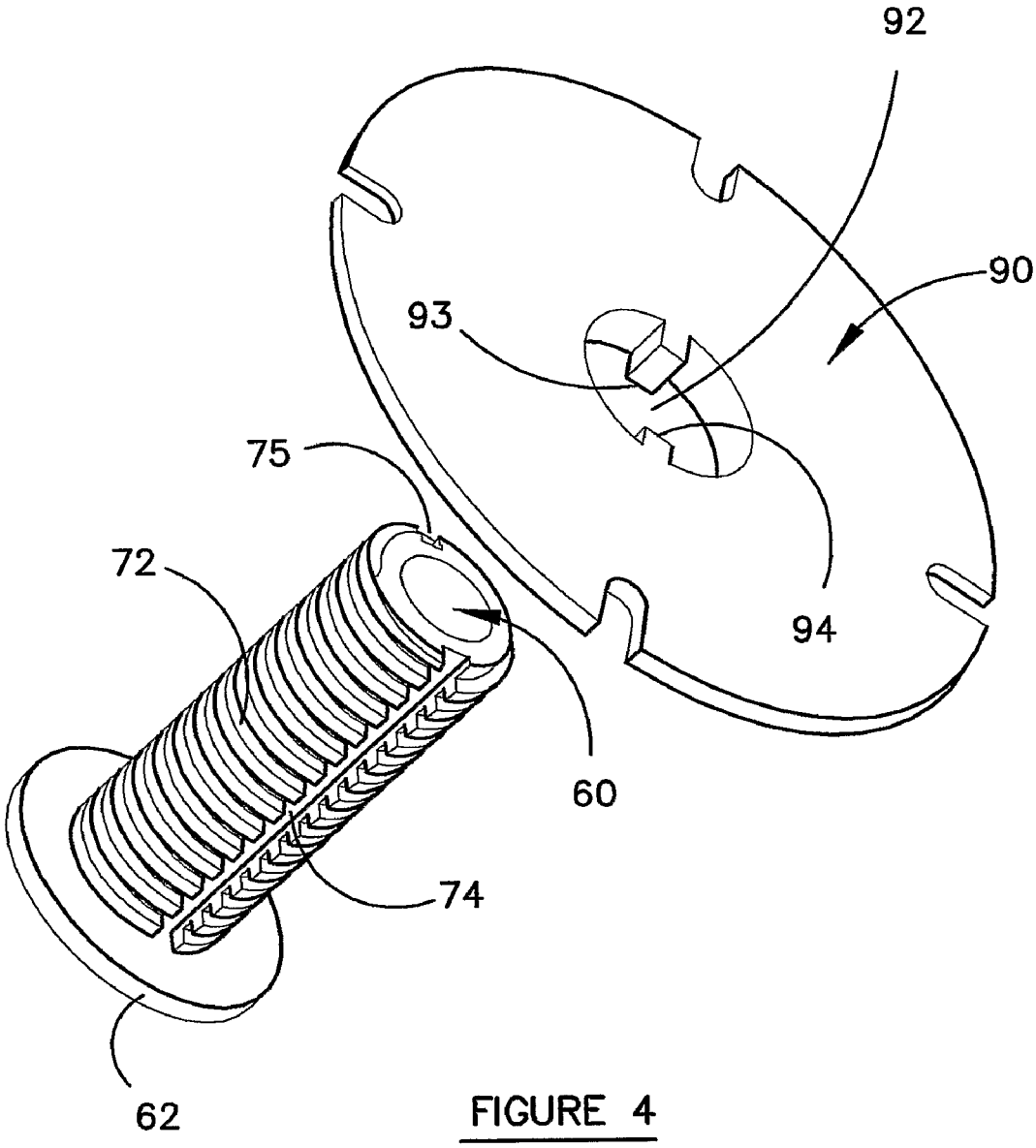
FIG. 4 is a perspective view of part of the system of FIG. 3.

The bolt 60 carries a screw thread 72 and also has diametrically opposed slots 74 and 75 which are best shown in the perspective view of the bolt 60 shown in FIG. 4.

A nut 78 is provided with an internal screw thread 79 which engages with the screw thread 72. The nut 78 also has an enlarged recess 80 which accommodates the flange 62 and cover 66 of the bolt 60. The nut 78 also carries an integral bevel gear 84 which meshes with a bevel gear 86 provided on the end of control shaft 46. The nut 78 is journalled in bearing 85 and has a peripheral flange 87.

A locating plate 90 is provided between the bevel gear 29 and the nut 78 and bearing 91 is located between the flange 87 and the plate 90 for supporting rotation of the nut 78 relative to the plate 90. The plate 90 is fixed to the housing 20 of the stern drive so the plate 90 cannot move.

As is best shown in FIG. 4, the plate 90 has a central opening 92 through which the bolt 60 can pass and carries a pair of lugs 93 and 94 which locate respectively in the grooves 74 and 75 of the bolt 60. The lugs 93 and 94 located in the grooves 74 and 75 prevent the bolt 60 from rotating so the bolt 60 is constrained for longitudinal linear movement in the direction of the first axis A of the propulsion system, about which the hub is rotated by the second drive shaft 30.

Thus, when the control shaft 46 is rotated, drive is transmitted to the nut 78 by the engagement of the bevel gears 84 and 86 so the nut 78 is rotated within the bearing 85 and the bearing 91. Rotation of the nut 78 causes the bolt 60 to move in the direction of the longitudinal axis A, either to the left or right in FIG. 3, depending on the direction of rotation of the nut 78. The longitudinal movement of the bolt 60 relative to the plate 90 is accommodated by the lugs 93 and 94 being able to slide in the grooves 74 and 75. In other words, the grooves 74 and 75 move over the lugs 93 and 94 when the bolt 60 is moved in the longitudinal direction, and at the same time prevent rotation of the bolt 60 so the push rod is constrained for longitudinal movement.

When the bolt 60 is moved to the left in FIG. 3, the flange 62 provides thrust to the annular thrust surface 57 of the thrust portion 56 via bearing 70 so the push rod 50 is pushed to the left in FIG. 3 whilst the push rod 50 rotates with the drive shaft 30. As mentioned above, the portion 56 is able to rotate in the chamber 66 with the rotation being supported by the thrust bearings 68 and 70 which also serve to transmit load from the flange 62 to the portion 56 when the bolt 60 is moved by rotation of the nut 78. If the nut 78 is rotated in the opposite direction, the bolt 60 is moved to the right in FIG. 3, and the cover 64 pushes against the thrust surface 58 of the portion 56 via the thrust bearing 68 so the push rod 50 is moved to the right in FIG. 3, whilst the push rod 50 rotates with the drive shaft 30.

The threads 75 and 79 are self-jamming and therefore prevent axial forces from the propeller blades being fed back into the control shaft 46. The thrust bearings 68 and 70 act in respective opposite directions when the push rod is pushed to the left or the right in FIG. 3, thereby absorbing the forces exerted by the push rod during movement, which is applied back to the push rod by the load applied to the propeller blades 34 when the propulsion system is in operation, and particularly when the pitch of the propeller blades is being adjusted whilst the hub 32 is rotating.

Figure 5:
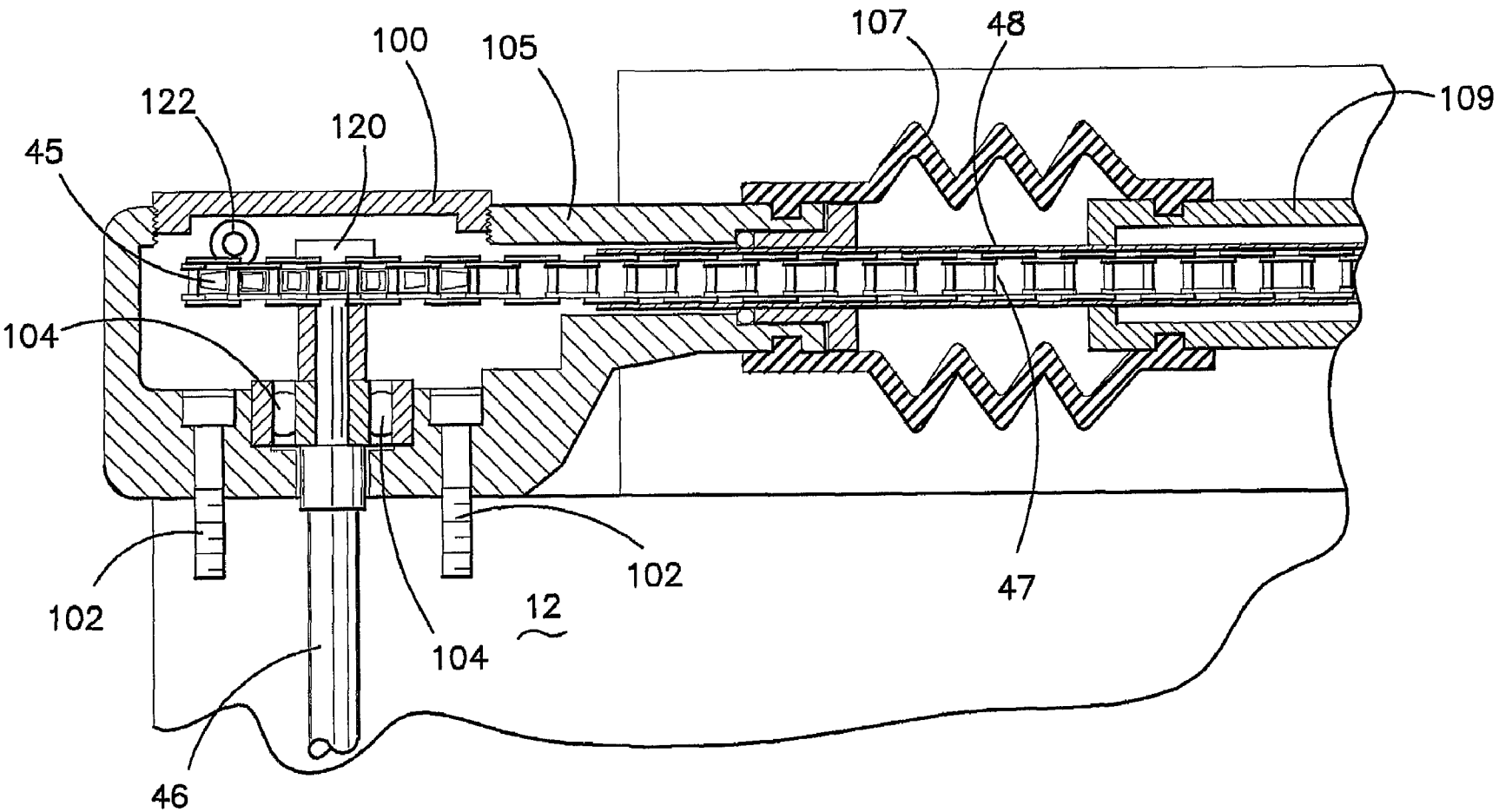
FIG. 5 is a view of the control mechanism of the propulsion system.

As is best shown in FIG. 2 and FIG. 5, the sprockets 45 and 49 and the chain 47 are external of the housing 20 of the stern drive 12. As is shown in FIG. 5, the sprocket 45 is mounted in a casing 100 which is connected to the housing 20 of the stern drive 12 via bolts 102. The control shaft 46 is supported in a bearing 104. The casing 100 connects with a hollow stem 105 to which a rubber boot 107 is connected. The boot 107 is also connected to a stem section 109. The chain 47 is provided in a plastic tube 48. A similar boot (not shown) is also arranged on the other side of the chain 47 (ie. the return side if the side shown in FIG. 5 is the advancing side). The boots 107 enable access to the chain 47 by removing the boots and sliding the tube 48 so that the chain 47 can be adjusted or maintained if necessary. The boots 107 and the stems 109 also provide adjustment of the chain by moving the control motor 38 and its control shaft 42 and gears 43 and 44 and sprocket 49, so as to tension the chain with the movement being accommodated by expansion or contraction of the boots 107. The control motor 38, the output shaft 42 and the gears 43 and 44 and sprocket 49 can then be locked in their adjusted position.

Thus, when the control motor 38 is operated, drive is transmitted to the nut 78 as previously mentioned, so that the push rod 50 is pushed either to the left or the right in FIG. 2 and FIG. 3 to adjust the pitch of the propeller blades 34.

The arrangement of the control motor 38, the chain 47 and the control shaft 46, as shown in FIG. 2, enables these control mechanisms to be added to an existing stern drive without alteration of the existing operating componentry. In stern drives, the space above the control shaft 46 is occupied by the input power shaft 16 from the motor 14, an exhaust duct (not shown), and sometimes cooling water channels and mounting and steering components. The space behind the drive shaft 26 is available on stern drives and even outboard motor installations. Thus, by providing the motor 38 in the position shown in FIG. 2 and connecting it to the control shaft 46 by the chain 47 an inexpensive and small space solution is provided to transmit power from the motor 38 to the control shaft 46. These components do not require any additional space in the vertical direction, because the chain can be guided around the existing upper leg part 20*a* of the stern drive 12. Furthermore, by using different gear sprocket diameters at the front and the rear, the overall transmission ratio between the motor 38 and the axial motion of the push rod 50 can be influenced.

Figure 6:
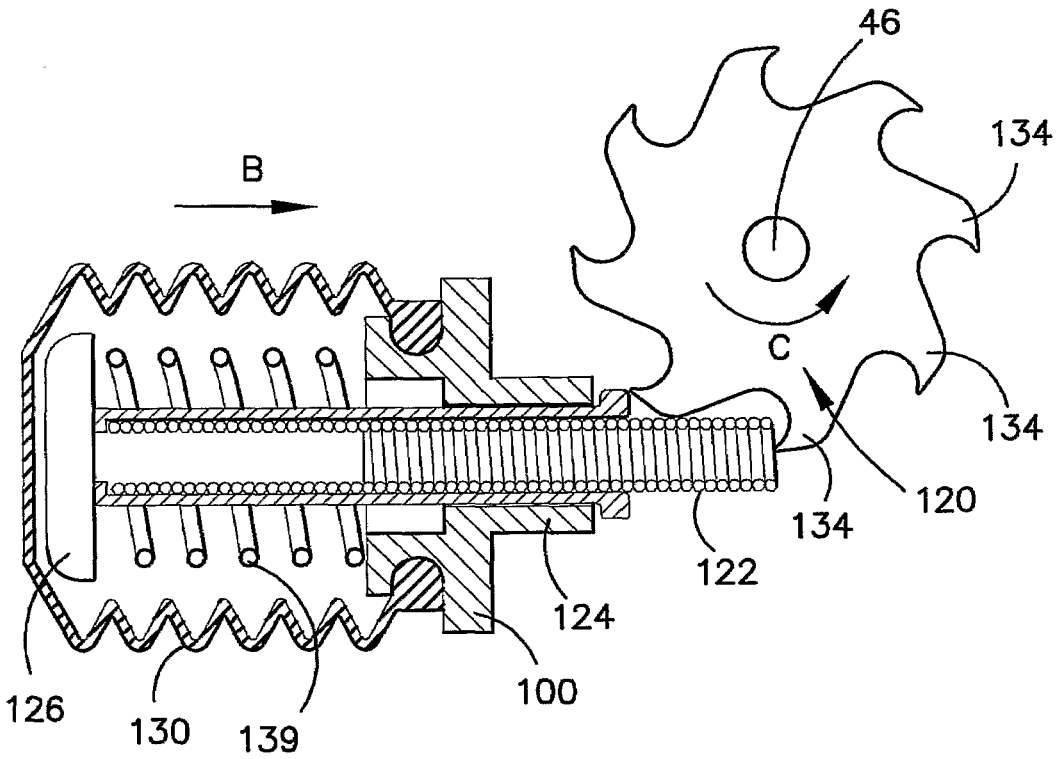
FIG. 6 is a view of an emergency pitch adjuster of the preferred embodiment of the invention.

FIG. 6 shows an emergency pitch adjuster for emergency adjustment of the pitch of the propeller blades 34, should the control motor or chain 47 malfunction. This mechanism allows the boat to still be driven if the other components of the propulsion system are operational to supply power to the drive shaft 30.

The emergency pitch adjuster comprises a sprocket gear or ratchet wheel 120 which is mounted on control shaft 46. A flexible push element 122, shown in the pushed-in position, is mounted to the housing 100 and passes through a hollow stem 124. The push element 122 has a button 126 external to the casing 100 on its end, and the external part of the push element 122 and button 126 are closed in a rubber boot 130 which is fixed to the casing 100 to seal the space inside the stern drive 10 from the outside.

The stem 122 is preferably a tightly wound spring so that the stem 122 is flexible but stiff in its axial direction. The sprocket wheel 120 includes teeth 134.

When the button 126 is pushed through the boot 130, the stem 122 is moved in the direction of arrow B in FIG. 6 against the bias of a return spring 139 which is arranged between the housing 100 and the button 126. This movement pushes the spring 122 against one of the teeth 134 to index the sprocket wheel 120 in the direction of arrow C in FIG. 6 to in turn rotate the control shaft 46 in that direction. When the button 126 is released, the push member 122 is returned to its intermediate position by the spring 139. Because of the flexible nature of the push member 122, the push member 122 can bend and simply ride over one of the gear teeth 134, should a gear teeth be in the way when the push member 122 returns. The button 126 can then be pressed so that the member 122 engages another of the teeth 134 to further index the sprocket wheel and control shaft 46 in the direction of arrow C in FIG. 6.

This continued indexing movement passes all the way through the system to the push rod 50 so the push rod 50 is moved to adjust the pitch of the propellers to a predetermined position, such as a fully forward position so the boat is able to take off and limp home.

FIGS. 7 to 12 show the coupling mechanism which couples the push rod 50 to the propeller blades 34 to adjust the pitch of the propeller blades relative to the hub 32.

Figure 7:
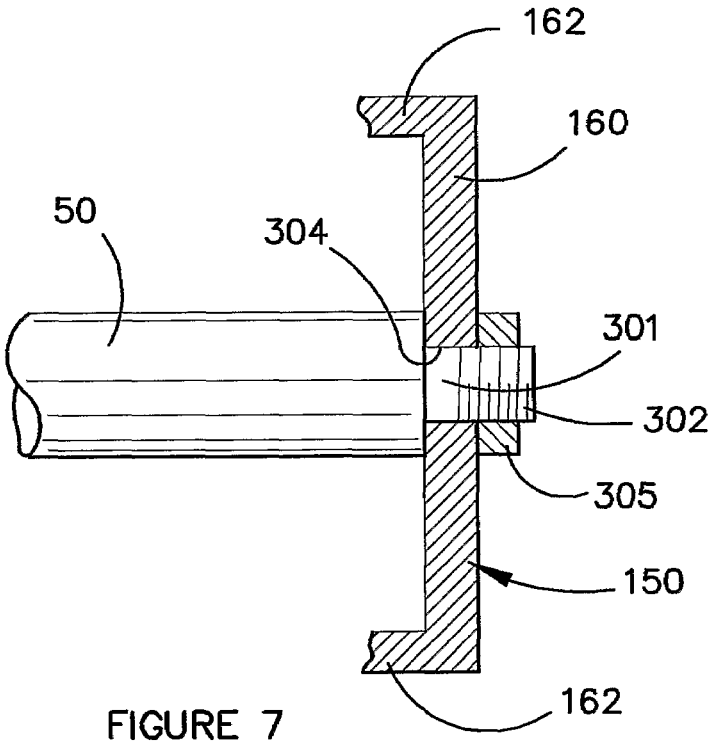
FIG. 7 is a partial cross-section and side view of part of the hub of the propulsion system.
Figure 8:
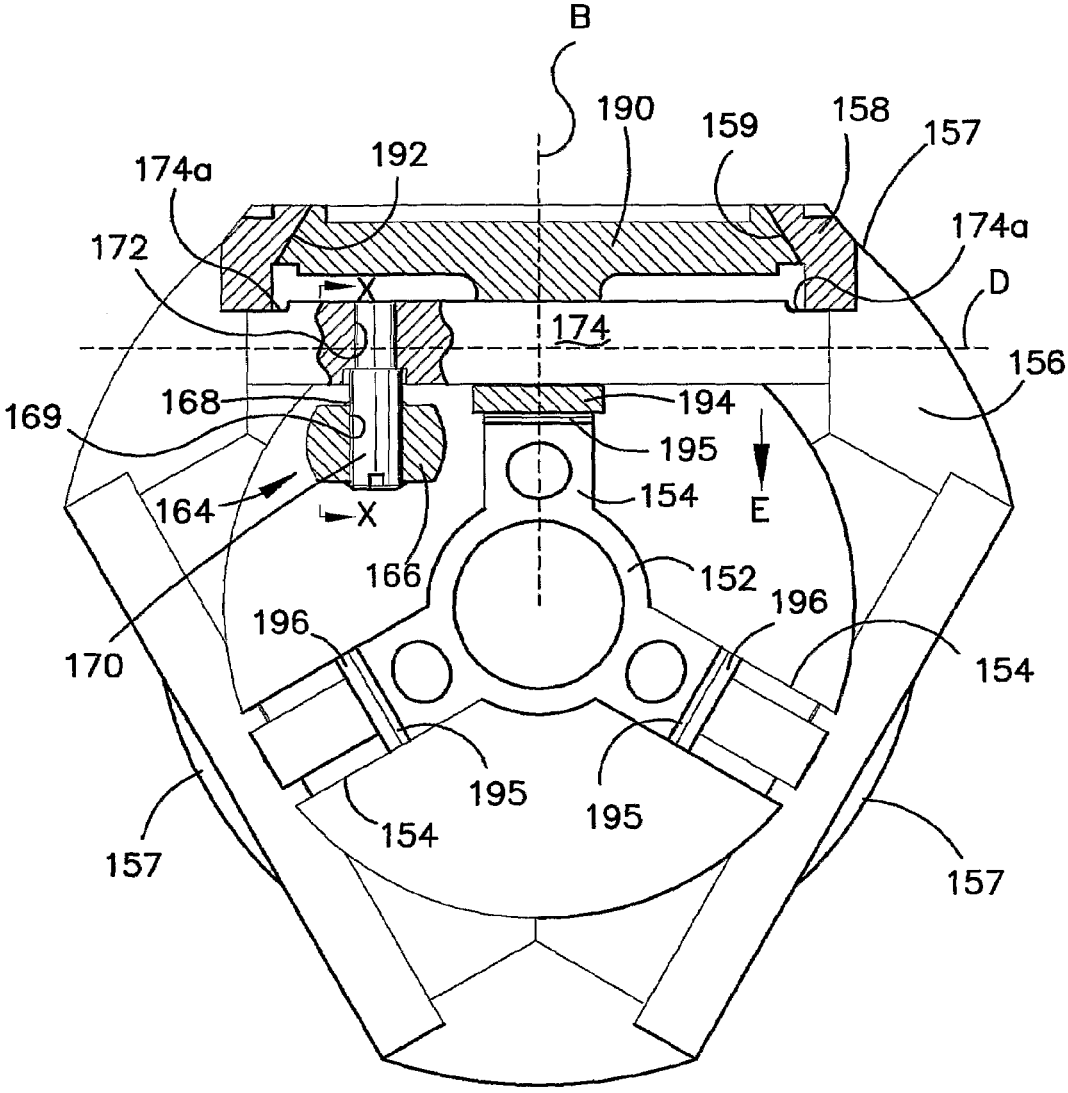
FIG. 8 is a cross section of the propeller hub of the propulsion system of the preferred embodiment.
Figure 9:
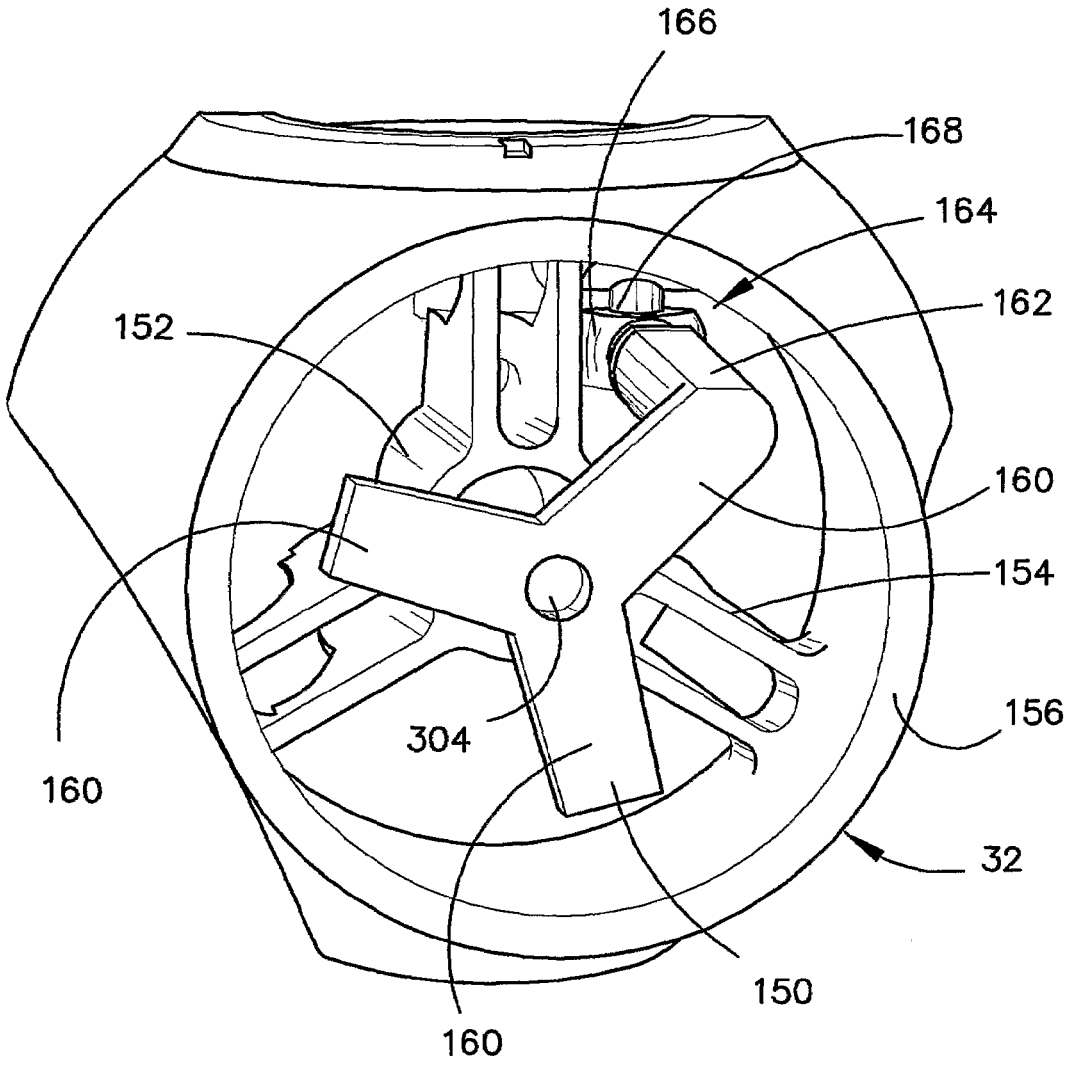
FIG. 9 is a perspective view from the rear of the hub of FIG. 7.

As is best shown in FIG. 9, an actuator claw 150 is located in the hub and is connected to the push rod 50. As is best shown in FIG. 7, the push rod 50 has a stem 301 which is provided with a screw thread 302. The claw 150 has a central hole 304 which receives the stem 301 and a nut 305 is screwed onto the screw thread 302 to fix the claw 150 to the push rod 50. Thus, when the push rod 50 moves along axis A, the claw is also moved with the push rod 50. As shown in FIGS. 8 and 9, the hub 32 is generally hollow and has a central hub 152 which is provided with ribs 154 which connect the central hub 152 to outer hub casing 156 of the hub 32. The claw 150 has three arms 160, one for each of the propeller blades 34. Since the mechanisms which are coupled to the fingers 160 are identical, only one is shown and will be described in FIGS. 8 and 9. Each arm 160 carries a finger 162 and a ball joint 164 (such as a rod end joint) is located at the end of each finger 162. The ball joint 164 is made up of a socket 166 and an eye 168 which is moveable in the socket 166. The eye 168 (as is best shown in FIG. 8) has a central bore 169 which carries a pin 170. The pin 170 is a sliding fit in the bore 169. The pin 170 engages in a bore 172 provided in an eccentric shaft 174.

The hub casing 156 is provided with three holes 157, one for each of the propeller blades 34. Each of the holes 157 is provided with a hub mount 158 which has a tapered internal surface 159. The propeller blades 34 have a blade base 190 which are provided with a tapered surface 192 which matches the taper of the surface 159. The base 190 has a stem 194 which is connected to the eccentric shaft 174. The central hub 152 is provided with a spring washer 195 for each of the stems 194. The spring washer 195 is located in a groove or recess 196 in the ribs 154. The spring washers 195 bear on the bottom surface of the stems 194. Instead of providing bias by way of the washer 195, the washer could be replaced by some other biasing mechanism, such as a conventional coil spring, resilient rubber block or the like.

When the push rod 50 is moved, the push rod 50 pushes against the claw 150, which in turn pushes the ball joint 164. The initial movement of the claw 150 causes the pin 170 to lean or tilt over slightly in the ball joint 164 so that the movement of the pin 170 causes the eccentric shaft 174 to rotate about eccentric axis D shown in FIG. 8.

Figure 7A:
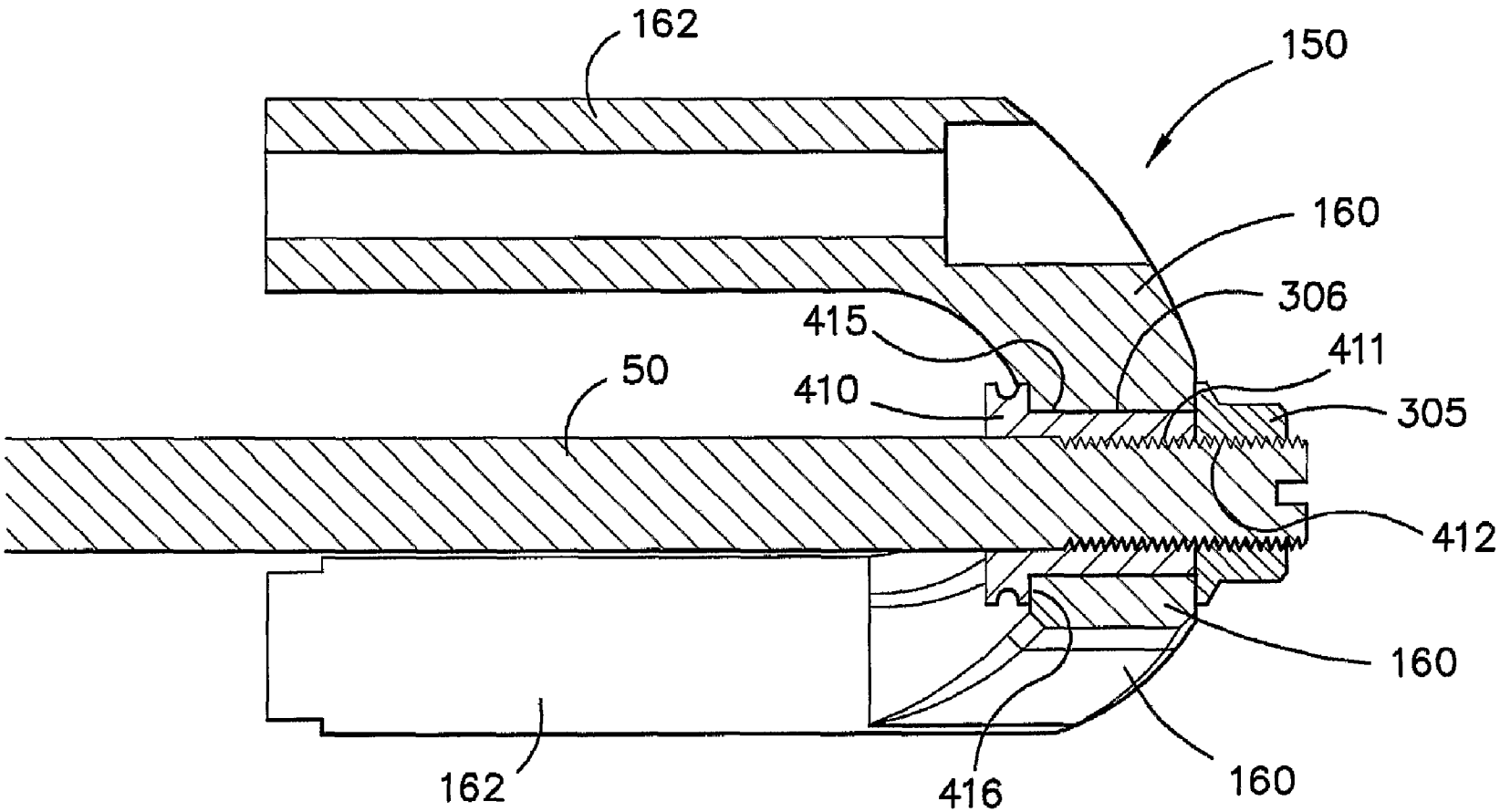
FIG. 7*a* is a view of an alternative embodiment to that shown in FIG. 7.

FIG. 7A shows an alternative embodiment to that shown in FIG. 7. In this embodiment the claw 150 is somewhat more accurate but still has the three fingers 162 (only two of which are shown in the cross-sectional view of 7A). In this embodiment the arms 160 are curved and merged into the fingers 162. The central hole 304 which receives the push rod 50 is provided with a bush 410 which is provided with an internal screw thread 411 which screws onto a screw thread 412 provided on the push rod 50. By rotating the bush 410 the claw 150 can be adjusted in position relative to the push rod 50 to in turn adjust the position of the ball joints 164 to set them in their optimum position for engagement with the eccentric shaft 174 and to locate the pins 170 in the optimum position for movement of the propeller blades about the transverse axis to adjust the pitch of the propeller blades 34. The claw 150 is fixed in position by the locking nut 305 which is also provided on the screw thread 412. The bush includes a recessed portion 415 and shoulder 416 for receiving the claw 150 and so the claw 150 can be jammed and locked into position between the locking nut 305 and the shoulder 416 of the bush 410 when the bush 410 is adjusted to in turn move the claw 150.

In a still further embodiment (not shown) the screw thread 411 could be formed direct on the claw 150 and the bush 410 omitted.

Figure 10:
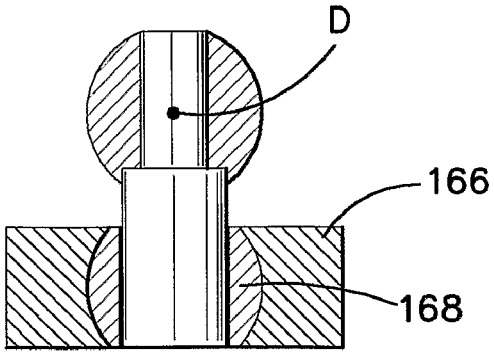
FIG. 10 is a view along the line X-X of FIG. 8.
Figure 11:
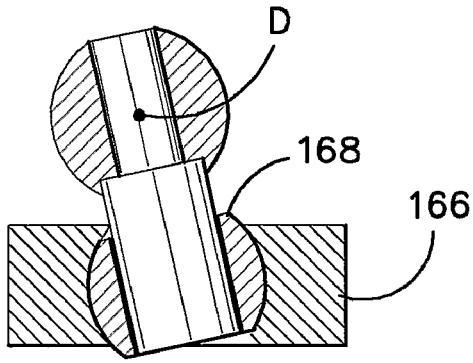
FIG. 11 is a view similar to FIG. 10 but in a second operational position.

FIG. 10 is a cross-sectional view along the line X-X of FIG. 8 and shows the position of the pin 170 before the push rod 50 is moved. FIG. 11 is a view similar to FIG. 10, but shows the position of the pin 170 after the initial movement of the push rod 50 which causes the pin 170 to lean slightly. The amount of leaning of the pin 170 in FIG. 11 is exaggerated to more clearly show the nature of the movement. This slightly leaning or tilting movement of the pin 170 causes the eccentric shaft 174 to rotate about the eccentric axis D so that the eccentric part 174*a* of the shaft 174 rotates away from the top dead centre position shown in FIG. 8 to a position more towards the bottom of the stem 194 which pushes the stem 194 and therefore the base 190 downwardly in FIG. 8 (and also as illustrated in FIG. 12).

Figure 12:
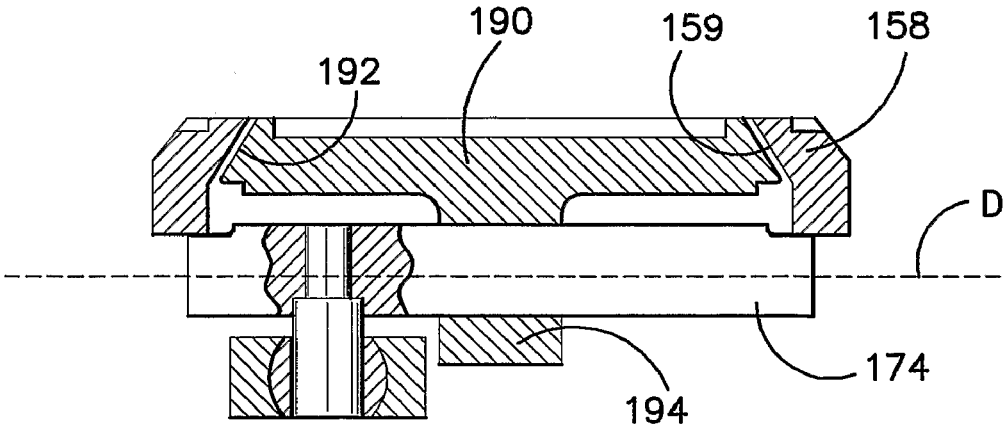
FIG. 12 is a view similar to FIG. 8 but in the second operational position.

As is apparent from FIG. 12, the inclined or tapered surface 159 defines an opening in which the base 190 locates. The opening defined by the inclined surface 159 increases in size from the radially outermost part (which is the upper part of the mount 158) to a radially innermost extremity which is at about the midpoint of the mount 158 shown in FIG. 12.

Thus, because of the eccentric nature of the shaft 174, this rotational movement pulls the base 190 very slightly downwardly in the direction of arrow E in FIG. 8 (by an amount of about one tenth of a millimeter) against the bias of the spring washer 195 so the tapered surface 192 is released from the tapered surface 159. Continued movement of the push rod 50 and the claw 150 will then push the finger 162 and the flexible joint 164 so the flexible joint moves into or out of the plane of the paper in FIG. 8, and this will cause the eccentric shaft 174 to rotate about transverse axis B. Because the stem 194 is connected to the shaft 174, the stem 194, and therefore the blade base 190 is also rotated about the transverse axis B. This in turn rotates the propeller blade 34 to thereby adjust the pitch of the propeller blade relative to the hub 32.

It will be apparent that all of the propeller blades 34 are adjusted in the same manner by this movement of the push rod 50, because the push rod 50 will engage the claw 150 and cause simultaneous movement of each of the legs 162.

When movement of the push rod 50 ceases after the push rod has been moved at a sufficient distance to adjust the pitch of the propellers to the required pitch position, the load is removed from the flexible joint 164 and the bias of the spring washer 195 together with the centrifugal force of the blades and the blade bases will push the stem 194 upwardly, again reengaging the tapered surface 192 with the tapered surface 159. This movement will also tend to rotate the shaft 174 back to its equilibrium position, and the pin 172 will also return to its equilibrium position (as shown in FIGS. 8 and 10) awaiting the next movement of the push rod 50 for further adjustment of the pitch of the propeller blades 34.

When the tapered surface 192 is again against the surface 159, flutter motion of the blades is prevented even under low loads and fatigue stresses are kept away from the operating parts of the coupling mechanism shown in FIGS. 7 and 8. The frictional engagement, and therefore locking of the propeller blade 32 to the hub 156 is accomplished by the force of the washer 195 which pushes the tapered surfaces 192 and 159 together. With increasing propeller speed, this force is further supported by centrifugal force caused by the mass of the rotating blades 32 and the blade bases 190.

It will be appreciated that when the propeller blades are adjusted in pitch, the pins 170 will travel in an arcuate path around the respective blade axes, and will therefore slightly change their distance from the central axis of the hub 32. In order to accommodate this, the claw 150 and the push rod 50 can rotate slightly relative to the hub 32 and the drive shaft 30 because the push rod 50 is free of the drive shaft 30 and is able to rotate in the chamber 66 as has been previously described.

The hub configuration described with reference to FIGS. 7 to 12 provides the advantage that exhaust gases from the engine 14 can be guided through the stern drive and the hub 32.

FIGS. 13 to 16 show a modified form of the hub according to FIGS. 7 to 12. Like references indicate like parts to those described with reference to FIGS. 7 to 12.

Figure 13:
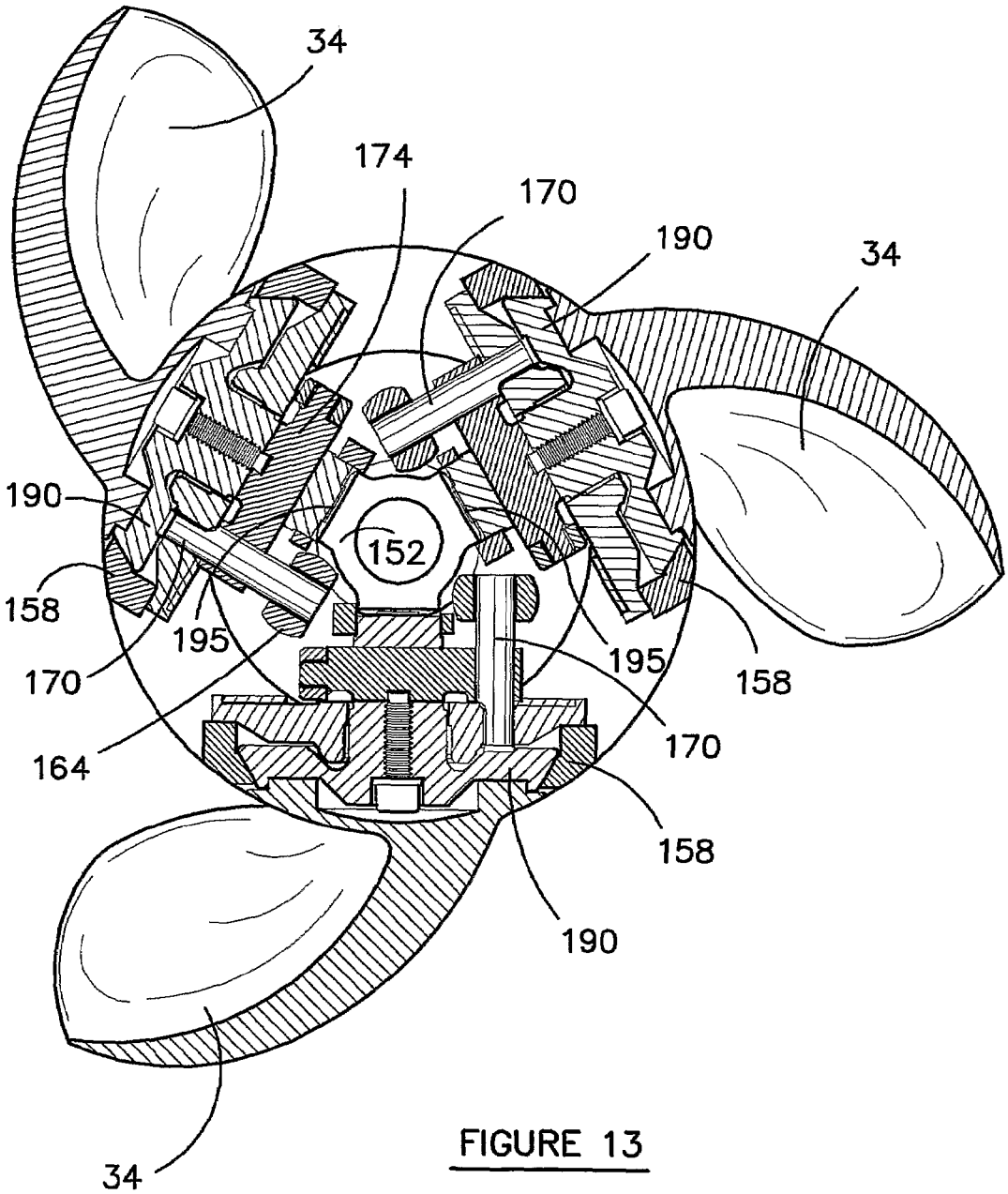
FIG. 13 is a cross-section of a modified hub according to another embodiment of the invention.

FIG. 13 is a cross-section (viewed from the front) which shows the three propeller blades, and the three separate mechanisms which adjust the pitch of the three propeller blades.

Figure 14:
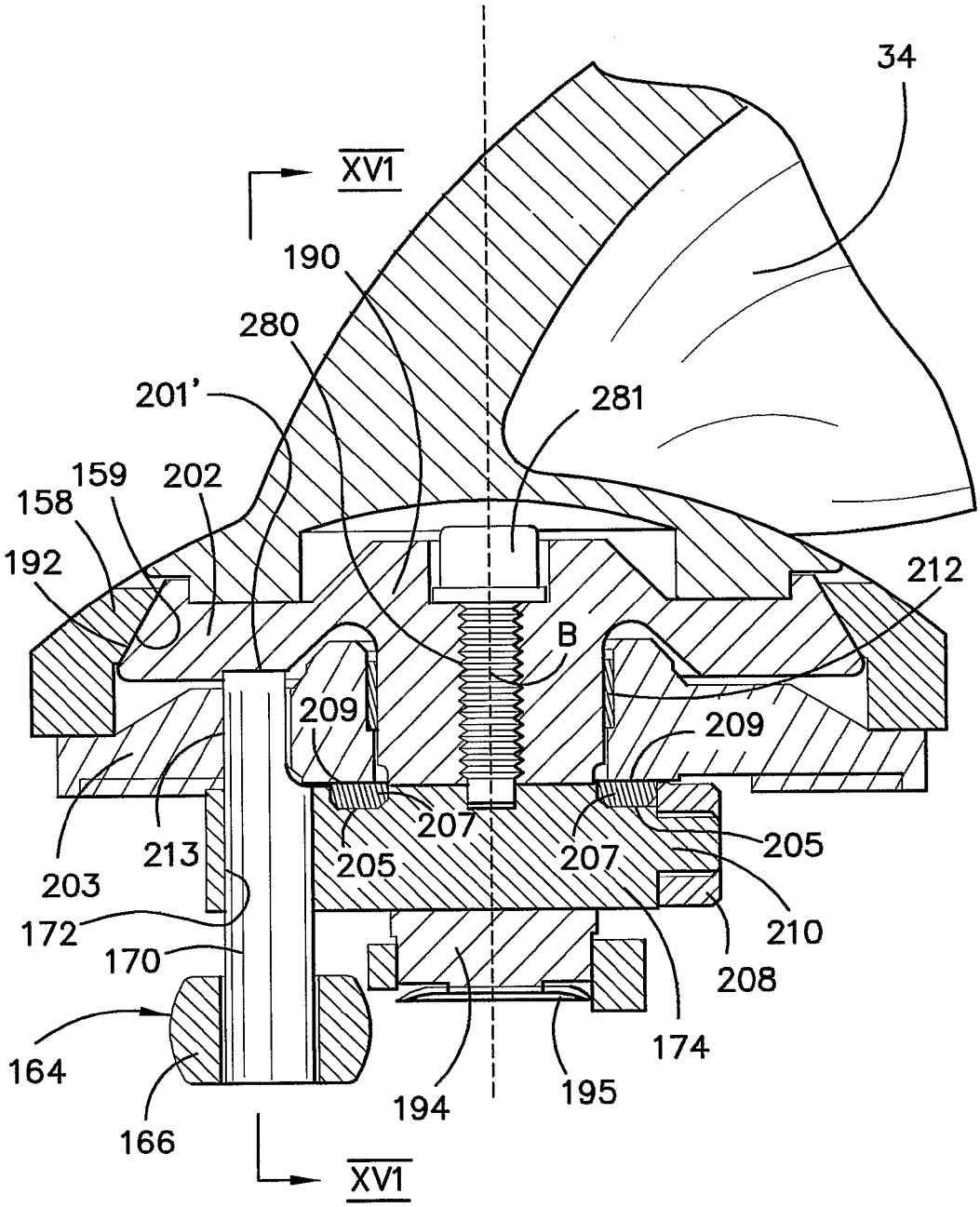
FIG. 14 is a more detailed view of one of the propeller and pitch adjustment arrangements of the hub of FIG. 13.

One of the mechanisms is shown in more detail in FIG. 14. With reference to FIG. 14, the blade base 190 is mounted on eccentric shaft 174, as in the earlier embodiment, by the eccentric shaft passing through an opening in stem 194 of the mount 190. The spring washer 195 is shown in FIG. 14, but the central hub 152 is omitted for ease of illustration. The joint 164 is also only schematically illustrated in FIGS. 13 to 18 for ease of illustration. The pin 170 passes through the eccentric shaft 174, as in the earlier embodiment, and engages in a groove 201 of plate section 202 of the base 190. The pin 170 is a loose fit in the groove 201, as will be explained in more detail hereinafter.

Figure 15:
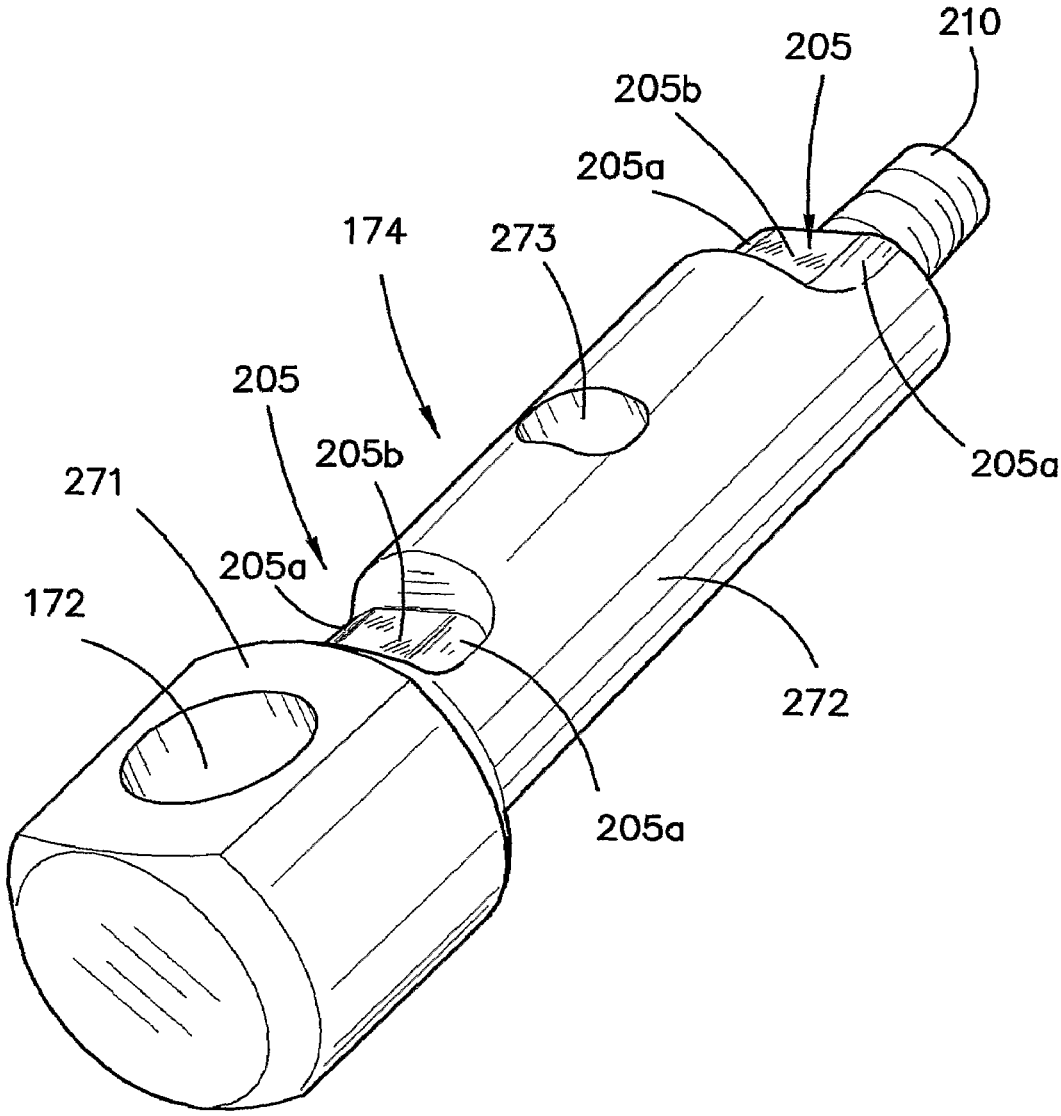
FIG. 15 is a perspective view of an eccentric shaft used in the embodiment of FIG. 13.

The shaft 174 is shown in detail in FIG. 15. As shown in FIG. 15, the shaft 174 has an enlarged head 271 in which bore 172 is provided. The pin 170 (not shown in FIG. 15) passes through the bore 172. The head 271 is enlarged to provide sufficient strength to the shaft 174 where the pin 170 passes through the bore 172. The shaft 174 has a stem portion 272 which is provided with two grooves 205. The grooves 205 have curved end regions 205*a* and flat middle region 205*b*. The curvature of the grooves 205 is slightly different to the remainder of the stem 272 to provide the eccentricity of the shaft 174 as will be described in more detail hereinafter. The stem 272 is provided with an elongate hole 273. The end of the stem 272 opposite the head 271 is provided with a stud 210.

Figure 16:
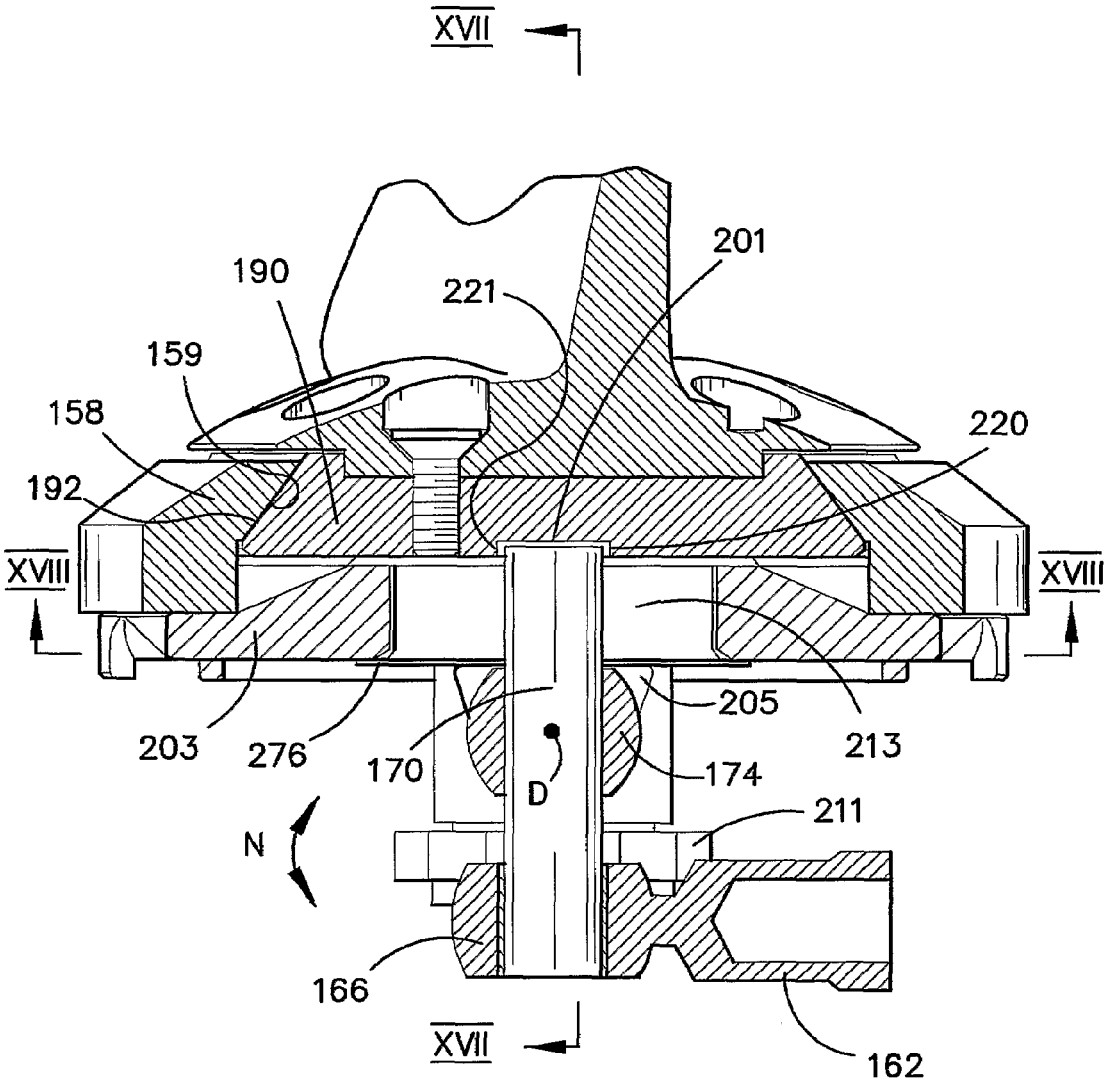
FIG. 16 is a view along the line XVI-XVI of FIG. 14.
Figure 17:
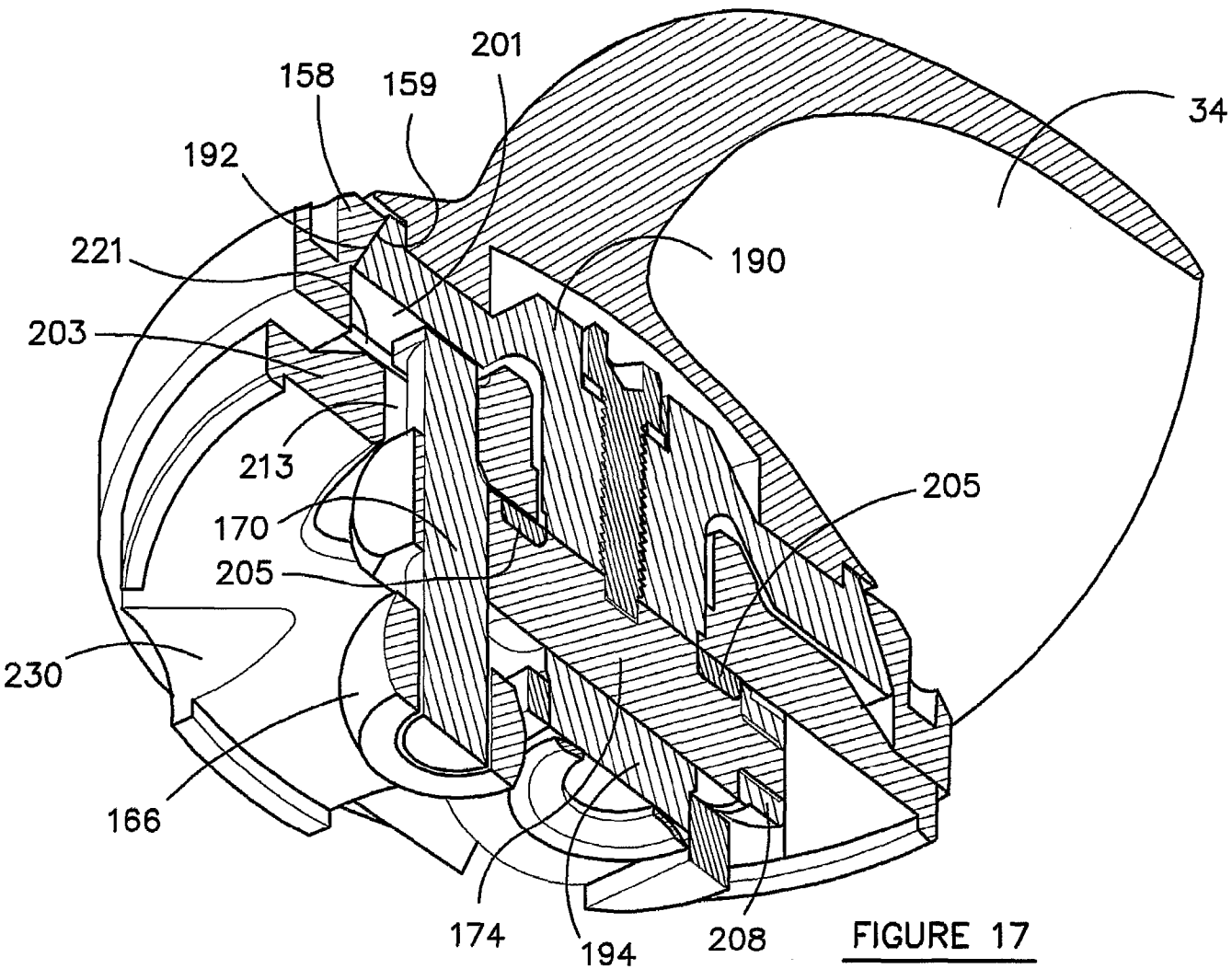
FIG. 17 is a partial cross-section perspective view generally along the line XVII-XVII of FIG. 16.

As shown in FIG. 14, a fixed bridge 203 is mounted between the base 190 and the eccentric shaft 174. Rotation journaling blocks 207 are mounted in the eccentric grooves 205 and bear on the lower surface 209 of the bridge 203. A nut 208 is screwed onto stud 210 to prevent the block 207 on the right hand side of FIG. 14 from slipping off the shaft towards the right in FIG. 14. The stem 194 of the base 190 is journaled in bushes or bearings 211 and 212. As is shown in FIGS. 14 and 16, the pin 170 passes through an arcuate slot 213 in the bridge 203. The slot 213 is also shown in FIG. 17. The arcuate slot 213 enables the pin 170 to engage in the groove 201 of the base 190, and also accommodates rotational movement of the pin 170, base 190 and blade 34 relative to the fixed bridge 203.

Figure 18:
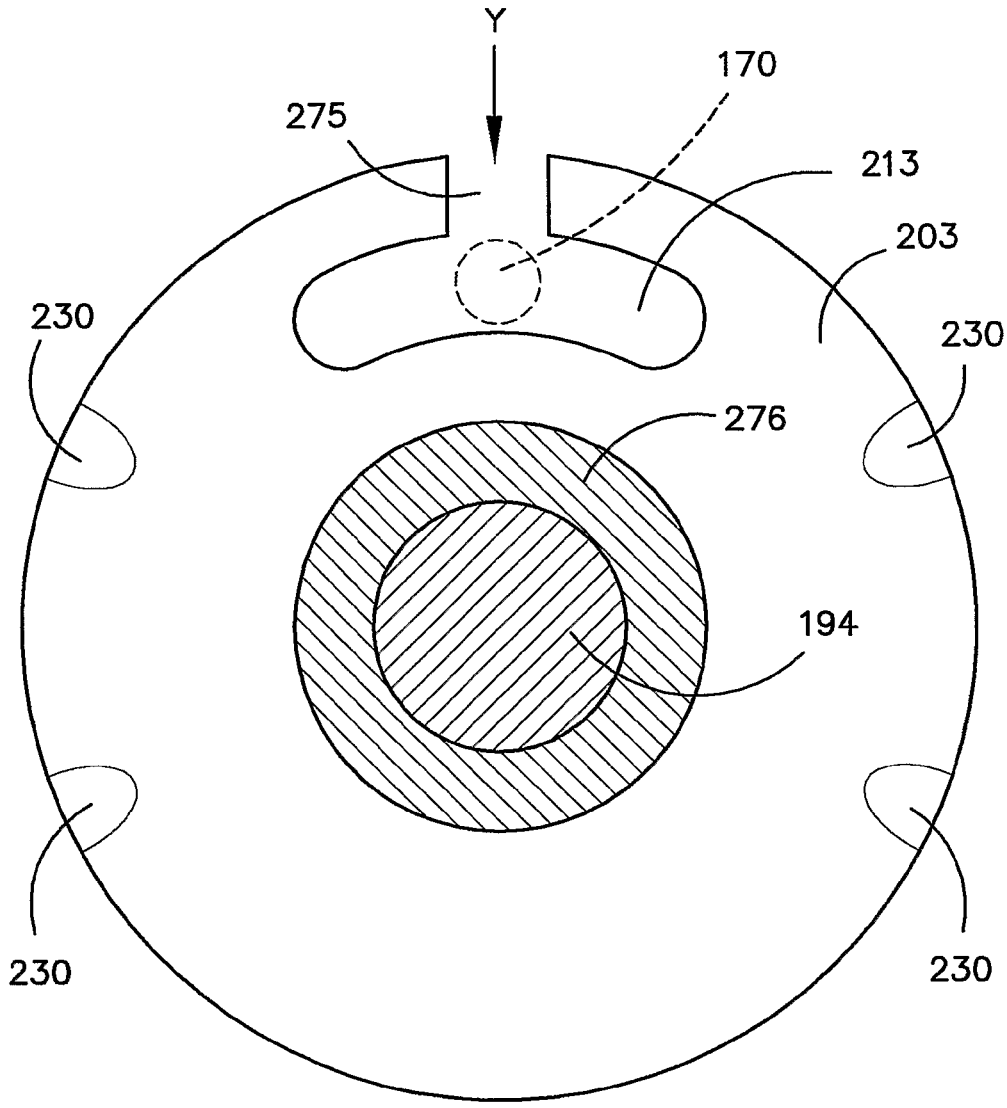
FIG. 18 is a view along the line XVIII-XVIII of FIG. 16.

As is shown in FIG. 18, the slot 213 in the bridge 203 communicates with an entrance slot 275 which merely facilitates assembly of the eccentric shaft 174 and pin 170 by enabling the pin 170 to slide in the direction of arrow Y in FIG. 18 into the arcuate groove 213, to in turn enable the eccentric shaft 174 to be positioned through the stem 194. The bridge 203 is also provided with a slightly raised annular land 276 on which the blocks 205 sit, and which provide a surface for facilitating movement of the blocks 205 when the propeller blade is adjusted. In the embodiments shown, two separate blocks 205 are provided. However, in other embodiments, a singular annular continuous block 205 could be provided which sits on the land 276 and has opposed portions contoured to match the contour of the grooves 205 in the eccentric shaft 174.

When the claw 150 is moved to adjust the pitch of the propeller blades 34 in the manner previously described, the arm 162 is moved to the right or left in FIG. 16. This in turn causes the pin 170 to tilt in the plane of the paper of FIG. 16 because of the relatively loose connection of the pin 170 in the socket 166. The tilting movement of the pin 170 rotates the eccentric 174 about its axis, which pushes the base 190 downwardly in FIGS. 14 and 16 against the bias of the spring washer 195 to release the bevel surface 192 of the base 190 from the bevel surface 159 of the hub mount 158. The tilting movement of the pin 170 is into and out of the plane of the paper in FIG. 14.

The eccentricity of shaft 174 in this embodiment is provided by the grooves 205 and the sliding blocks 207 so that rotation of the shaft 174 will tend to force the stem 194 downwardly against the bias of the washer 195.

With reference to FIG. 16, as the pin 170 tilts to the right or left to rotate the shaft 174 and remove the surface 159 away from the surface 192, the shaft will eventually contact side surface 220 or 221 (depending on the direction of movement of the arm 162 and therefore of the tilting movement of the pin 170). Continued movement of the arm 162 will therefore rotate the base 190 about axis B shown in FIG. 14. It should be noted that the movement of direction of the pin 170 in FIG. 14 is into and out of the plane of FIG. 14. Thus, when the pin contacts the surface 220 or 221, the base 190 is rotated about the axis B.

As previously mentioned in relation to the earlier embodiments, the rotation of the eccentric shaft 174 pulls the stem 194 downwardly a very slight amount in the order of one tenth of a millimeter. This movement removes the load from the surfaces 192 and 159 so that the load carrying surfaces on the sliding blocks 207 which run on a smaller radius can take over the load. The movement of the surfaces 159 and 192 are a sliding movement on one another with very little, if any, spacing between the surfaces. This is advantageous because it prevents sand and other small particles from entering the mechanism between the surfaces 192 and 159. When the stem 194 does move downwardly slightly because of rotation of the eccentric 174, load is shifted from between the surfaces 192 and 159 to the surface engagement between the eccentric 174 and the inner periphery of the opening in the stem 194 through which the eccentric 174 passes. As the eccentric 174 rotates, the load is transferred to the blocks 205 and 207 and in turn to the surface 209 of the bridge 203. Thus, the load is transmitted from the larger diameter or radius defined by the surfaces 159 and 192 to a much smaller diameter defined by the blocks 207 and the surface 209 so that continued movement of the push rod can rotate the eccentric 174 and therefore the stem 194 about the transverse axis to adjust the pitch of the propeller blade 34. When adjustment has completed, centrifugal force acting on the propeller blade 34 and the base 190 tends to push the blade 34 outwardly so that the eccentric 174 and pin 170 can move slightly, allowing the load to be retransferred to the surfaces 192 and 159 to lock the propeller blade in the pitch adjusted position. The spring 195 may facilitate some of the return movement of the eccentric 174 and 170. However, centrifugal force is primarily responsible for the reengagement of the surfaces 192 and 159 so that the load between those surfaces lock the propeller blade 34 in the pitch adjusted position.

Thus, whilst the spring washer 195 can be solely responsible for returning the shaft 174 and the pin 170 to the equilibrium position, this may also occur as a result of a slight fluttering of the blade 34 as the blade 34 settles at its adjusted position, and the centrifugal force which is supplied to the blade 34 and the base 190 when the propeller 32 is rotating.

As is best shown in FIG. 14, the base 190 is provided with a screw threaded bore 280 which receives a bolt 281. The bolt 281 projects into the hole 273 in the shaft 174 to locate the shaft 174 in place and prevent movement of the shaft to the left and right in FIG. 14 to thereby prevent the shaft moving out of position during adjustment of the pitch of the propeller blades 34 when load is applied to the shaft 174 by the respective arm 162 and pin 170.

Figure 19:
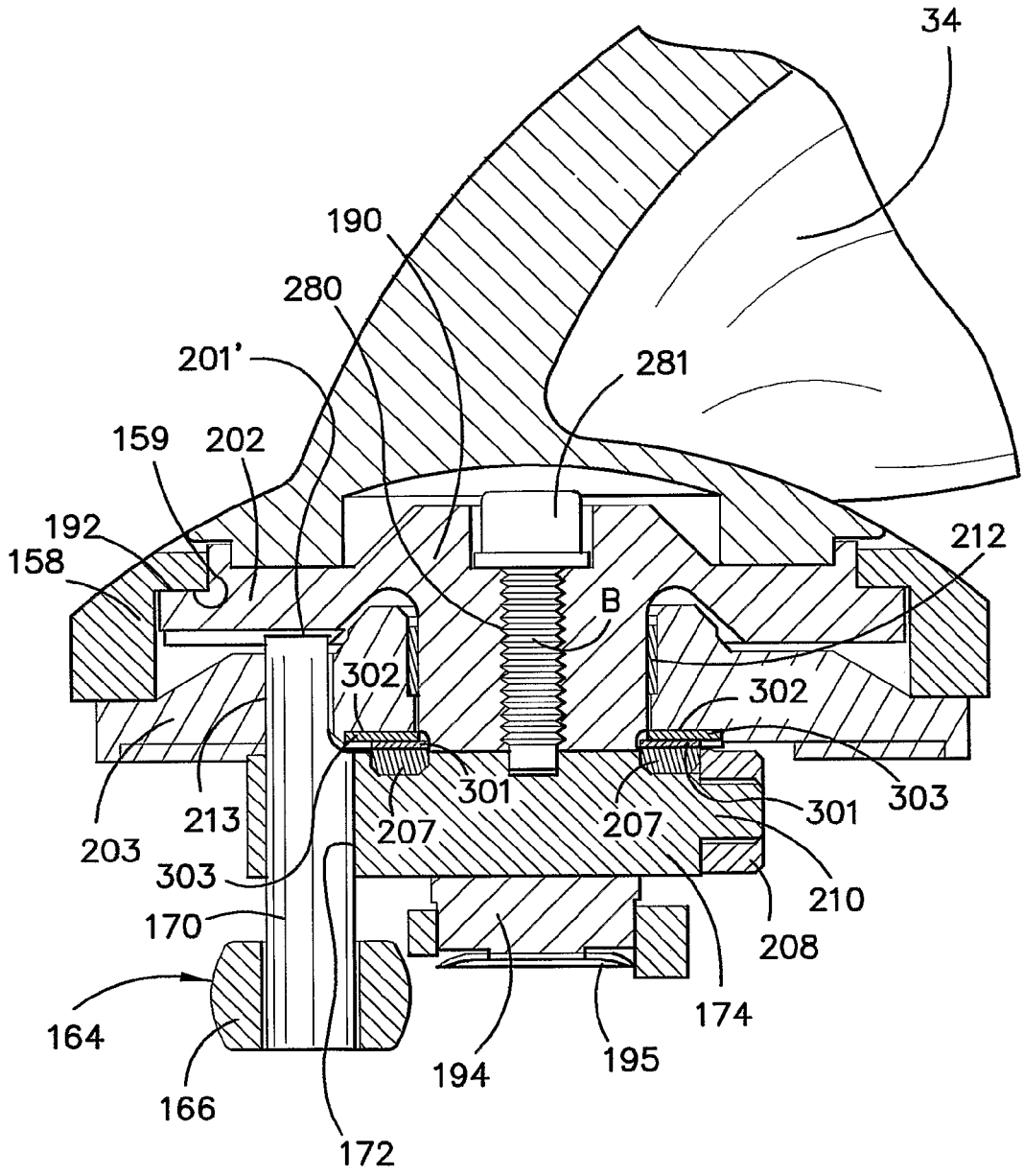
FIG. 19 is a view of a further embodiment of the invention.

FIG. 19 shows a still further embodiment of the invention in which like reference numerals indicate like parts to those described with reference to FIG. 14. In this embodiment the surfaces 192 and 159 are substantially horizontal surfaces rather than inclined or cone-shaped, as in the previous embodiments, and are generally perpendicular to the axis about which the propeller blade 34 is adjusted.

In this embodiment the blocks 207 are provided with ceramic surfaces 301 which may be glued to the blocks 207 simply to hold the surfaces 301 in position during assembly. The fixed bridge 203 is provided with an annular recess 302 into which is inserted an annular ceramic ring 303 on which the surface 301 sits. Thus, in this embodiment, when the eccentric 174 is rotated and the load is removed from the surfaces 159 and 192, the load is transferred to the surfaces 301 and ring 303 and then through the bridge 203 to the mount 158. Once again, the transfer of the load from the larger diameter or radius defined by the surfaces 159 and 192 to the smaller diameter defined by the blocks 207 and ring 303 makes adjustment of the pitch around the transverse axis possible, as in the embodiment of FIG. 14.

In the embodiment of FIG. 19 and the earlier embodiments, the base 190 is preferably formed from steel and the mount 158 from brass. The eccentric 174 is formed from brass and the blocks 207 from steel.

In the embodiments described with reference to FIGS. 7 to 18, exhaust from the motor 14 passes through the hub 32. The bridge 203 may be provided with grooves 230 to assist in venting exhaust gas through the hub 32 to atmosphere. However, in other embodiments, the hub 32 could be sealed and the mechanism for adjusting the pitch of the propeller blades immersed in an oil bath, with the exhaust being vented to atmosphere other than through the hub 32. Furthermore, the mechanism may have a different relative position of the pins 170, eccentric 174 and the stem 194 to that shown in FIGS. 7 to 16.

In the claims which follow and in the preceding description of the invention, except where the context requires otherwise due to express language or necessary implication, the word "comprise", or variations such as "comprises" or "comprising", is used in an inclusive sense, ie. to specify the presence of the stated features but not to preclude the presence or addition of further features in various embodiments of the invention.

Since modifications within the spirit and scope of the invention may readily be effected by persons skilled within the art, it is to be understood that this invention is not limited to the particular embodiment described by way of example hereinabove.

What is claimed is:

1. A propeller for a marine propulsion system, comprising:

a propeller hub having a plurality of openings, and a hub surface surrounding each opening;

a propeller blade having a propeller base mounted in each of the openings, each base having a base surface for engaging the hub surface of the respective opening;

a mechanical and non-hydraulic unlocking mechanism for disengaging the respective base surface of the base from the respective hub surface of the hub for enabling rotation of the base, and therefore the propeller blade relative to the hub about an axis transverse to a rotation axis of the hub, by a sliding movement of the hub surface with respect to the base surface; and a pitch adjusting mechanism for rotating each base to thereby adjust the pitch of the propeller blade.

2. The propeller of claim 1 further comprising a mechanical and non-hydraulic re-locking mechanism for allowing re-engagement of the respective base surface of the base with the respective hub surface of the hub to lock the base in the pitch adjusted position.

3. The propeller of claim 2 wherein the unlocking mechanism and the re-locking mechanism comprise a common locking and unlocking mechanism.

4. The propeller of claim 2 wherein the re-locking mechanism allows re-engagement of the base surface with the hub surface by virtue of centrifugal force during operation of the propeller after the pitch adjusting mechanism has adjusted the pitch of the propeller blades.

5. The propeller of claim 3 wherein the common locking and unlocking mechanism comprise a stem on each base, a respective eccentric coupled to each stem, a respective pin mounted to each eccentric, a push rod for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to reengage the respective base surface of the bases with the respective hub surfaces of the openings to re-lock the bases and therefore the propeller blades in the pitch adjusted position.

6. The propeller according to claim 1 wherein the mechanical unlocking mechanism disengages the respective base surface from the respective hub surface by transferring load from the base surface and hub surface to thereby allow the hub surface and base surface to move relative to one another.

7. The propeller according to claim 6 wherein the unlocking mechanism comprises an eccentric, at least one engaging element on the eccentric, a slide surface arranged radially inwardly of the respective hub surface and base surface so that when the eccentric is rotated, load is transferred from the respective hub surface and base surface to the at least one element and slide surface so the respective propeller blades can be adjusted after the transfer of load with the at least one element sliding on the slide surface.

8. The propeller according to claim 7 wherein the slide surface is arranged on a fixed bridge.

9. The propeller according to claim 7 wherein the element comprises two elements, each element having a slide member and the slide surface being a ceramic slide surface for engaging with the slide members of the elements.

10. The propeller according to claim 7 wherein the eccentric is coupled to a pin for firstly rotating the eccentric about a first axis to transfer the load and then rotating the eccentric about a second axis transverse to the first axis to rotate the respective propeller blade to adjust the pitch of the propeller blade.

11. The propeller according to claim 1 wherein the hub surface and the base surface are inclined cone-shaped surfaces.

12. The propeller according to claim 1 wherein the hub surface and base surface are substantially horizontal surfaces perpendicular to an axis about which the pitch of the propeller blades is adjusted.

13. The propeller of claim 5 wherein the push rod is coupled to a claw which has a respective finger for each of the propeller blades, each finger being mounted to a respective pin by a socket and eye joint.

14. The propeller of claim 13 wherein an adjusting mechanism is provided for enabling adjustment of the claw with respect to the push rod.

15. The propeller of claim 14 wherein the adjusting mechanism comprises a bush screw threaded on the push rod by co-operating screw threads on the bush and push rod, the bush carrying the claw, and a locking nut for locking the bush and therefore the claw in a desired position relative to the push rod.

16. The propeller of claim 5 wherein the pin locates in a recess in the base so that after the pin rotates the eccentric, the pin engages the base to thereby rotate the base about the transverse axis to adjust the pitch of the propeller blade.

17. The propeller of claim 16 wherein a fixed bridge is located between each base and each eccentric, the bridge having an arcuate slot through which the respective pin passes to accommodate movement of the pin relative to the bridge.

18. A marine propulsion system to be driven by a motor, the system comprising:

a propeller having a propeller hub and a plurality of propeller blades;

a drive for rotating the propeller about a first axis;

a pitch adjusting mechanism for adjusting the pitch of the propeller blades about respective axes transverse to the first axis;

a blade supporting mechanism for supporting the blades in the hub to allow adjustment of the pitch of the blades about the transverse axes, the supporting mechanism comprising:

an engaging element for movement by the adjusting mechanism to adjust the pitch of the blades; the engaging element having an arm for each of the blades;

a flexible joint carried by the arm;

a pin mounted in the joint;

an eccentric in engagement with the pin;

a propeller base connected to the eccentric, the propeller base having a base surface;

a base surface on the hub for engagement with the base surface on the base so the base surface of the base engages the base surface of the hub to lock the propeller in a pitch adjusted position; and wherein when the adjusting mechanism moves the engaging element, the engagement between the flexible joint and the pin causes the joint and pin to first rotate the eccentric about an eccentric axis to disengage the base surface of the base and the hub base surface of the hub, and whereupon further movement of the adjusting mechanism, and therefore the element, rotates the eccentric and the base relative to the hub about the transverse axis to adjust the pitch of the propeller blades.

19. The system of claim 18 wherein the hub surface and base surface are tapered surfaces.

20. The system of claim 18 wherein a biasing means is provided for biasing the base surface towards the hub and wherein the biasing means also assists in biasing the eccentric and pin back towards an equilibrium position.

21. The system of claim 18 wherein the joint comprises an outer socket and an inner moveable eye in the socket which carries the pin.

22. The system of claim 18 wherein the eccentric is an eccentric shaft.

23. The system of claim 22 wherein the base includes a stem which engages the eccentric shaft so that rotation of the eccentric shaft about the eccentric axis moves the base relative to the hub in a radial direction so the tapered surface of the base can disengage from the tapered surface of the hub, and continued movement of the arm rotates the eccentric shaft about the respective transverse axis to thereby adjust the pitch of the blade relative to the hub about the respective transverse axis.

24. The system of claim 18 wherein the drive comprises:

a first drive shaft for receiving rotary power from the motor;

a second drive shaft arranged transverse to the first drive shaft; a first gear on the first drive shaft;

a second gear on the second drive shaft meshing with the first gear so that drive is transmitted from the first drive shaft via the gears to the second drive shaft; and the propeller hub being connected to the second drive shaft for rotation with the second drive shaft.

25. The system of claim 18 wherein the pitch adjusting mechanism comprises a push member for moving the engaging element to thereby move the propeller blades and adjust the pitch of the propeller blades, the push member having a screw thread, a nut member having a screw thread and engaging the screw thread of the push member, and a control mechanism for rotating the nut to move the push member because of the engagement of the screw thread of the push member, and the screw thread on the nut, so the push member is moved in a linear manner to move the element to thereby increase the pitch of the propeller blades.

26. The system of claim 25 wherein the push member comprises a push rod and a bolt provided about the push rod so the push rod can rotate relative to the bolt, the screw thread of the push member being provided on the bolt, the bolt having a chamber for receiving a thrust portion of the push rod so that upon rotation of the nut in one direction, the bolt is moved in a first direction parallel to the first axis and the push rod is moved with the bolt whilst being able to rotate within the bolt because of the engagement of the thrust portion in the chamber, and upon rotation of the nut member in the opposite direction, the bolt and the push rod are moved in a second direction opposite the first direction parallel to the first axis because of the engagement of the thrust portion of the push rod in the chamber.

27. The system of claim 24 wherein the second drive shaft is hollow and the push rod is arranged in the second drive shaft so that the push rod can rotate with the second drive shaft whilst being moveable in the first and second directions along the first axis.

28. The system of claim 27 wherein the push rod has a retaining member for retaining the bolt for movement in the direction of the first axis, but preventing rotation of the bolt about the first axis.

29. The system of claim 26 wherein the chamber is formed by a flange on the bolt and a cover connected to the flange, the thrust portion of the push rod having a pair of thrust surfaces, and thrust bearing disposed between one of the thrust surfaces and the flange, and the other of the thrust surfaces and the cover.

30. The system of claim 18 wherein the disengagement of the base surface and the hub surface comprises a transfer of load from the base surface and hub surfaces so the base surface and hub surfaces can rotate relative to one another by a sliding action.

* * * * *